US010718595B2

(12) United States Patent
Barnette

(10) Patent No.: US 10,718,595 B2
(45) Date of Patent: Jul. 21, 2020

(54) QUICK-DETACHABLE MULTI-PURPOSE ACCESSORY MOUNTING PLATFORM

(71) Applicant: Digital to Definitive, LLC, Austin, TX (US)

(72) Inventor: Darrel R. Barnette, Austin, TX (US)

(73) Assignee: DIGITAL TO DEFINITIVE, LLC, Austin, TX (US)

( * ) Notice: Subject to any disclaimer, the term of this patent is extended or adjusted under 35 U.S.C. 154(b) by 0 days.

(21) Appl. No.: 15/995,446

(22) Filed: Jun. 1, 2018

(65) Prior Publication Data

US 2018/0299237 A1 Oct. 18, 2018

Related U.S. Application Data

(63) Continuation-in-part of application No. 15/468,011, filed on Mar. 23, 2017, now abandoned.
(Continued)

(51) Int. Cl.

| | |
|---|---|
| ***F42B 6/08*** | (2006.01) |
| ***F42B 7/10*** | (2006.01) |
| ***F41A 9/59*** | (2006.01) |
| ***F42B 10/02*** | (2006.01) |
| ***F42B 14/06*** | (2006.01) |
| ***F41J 9/30*** | (2006.01) |
| ***F41G 11/00*** | (2006.01) |
| ***F42B 14/02*** | (2006.01) |
| ***F42B 12/56*** | (2006.01) |

(Continued)

(52) U.S. Cl.

CPC ..... *F42B 6/08* (2013.01); *F41A 9/59* (2013.01); *F41A 35/00* (2013.01); *F41C 27/00* (2013.01); *F41C 33/00* (2013.01); *F41G 11/004* (2013.01); *F41J 9/30* (2013.01); *F42B 7/04* (2013.01); *F42B 7/10* (2013.01); *F42B 10/02* (2013.01); *F42B 10/06* (2013.01); *F42B 12/362* (2013.01); *F42B 12/56* (2013.01); *F42B 14/02* (2013.01); *F42B 14/06* (2013.01); *F42B 14/062* (2013.01); *F42B 14/067* (2013.01); *F41A 11/00* (2013.01); *F41A 27/00* (2013.01); *F41C 33/007* (2013.01)

(58) Field of Classification Search

CPC .... F41A 9/59; F42B 6/08; F42B 10/02; F42B 10/06; F41C 27/00

USPC ..... 473/583

See application file for complete search history.

(56) References Cited

U.S. PATENT DOCUMENTS 3,138,383 A 5/1964 McKinzie
3,910,579 A 10/1975 Sprandel
(Continued)

OTHER PUBLICATIONS

James Barrowman, Calculating the Center of Pressure of a Model Rocket, TR-33 Model Rocket Technical Report, 2012, p. 18,Centuri Engineering Company, Phoenix, AZ, USA.
(Continued)

*Primary Examiner* — John E Simms, Jr.
*Assistant Examiner* — Rayshun K Peng
(74) *Attorney, Agent, or Firm* — Bennet K. Langlotz; Langlotz Patent & Trademark Works, LLC

(57) ABSTRACT

Accessories may be mounted using a quick-detachable multi-purpose accessory mounting platform. The platform may include one or more clamps to receive an object, such as a firearm. The platform also may include at least one recessed mounting pad, at least one rear shelf, and other surfaces to provide different mounting points for accessories.

14 Claims, 31 Drawing Sheets

Related U.S. Application Data

(60) Provisional application No. 62/312,275, filed on Mar. 23, 2016.

(51) Int. Cl.

| | |
|---|---|
| ***F42B 7/04*** | (2006.01) |
| ***F42B 10/06*** | (2006.01) |
| ***F41C 33/00*** | (2006.01) |
| ***F42B 12/36*** | (2006.01) |
| ***F41A 35/00*** | (2006.01) |
| ***F41C 27/00*** | (2006.01) |
| *F41A 11/00* | (2006.01) |
| *F41A 27/00* | (2006.01) |

(56) References Cited

U.S. PATENT DOCUMENTS

| | | | | |
|---|---|---|---|---|
| 4,534,568 | A | 8/1985 | Tone | |
| 4,998,994 | A * | 3/1991 | Schmidt | F42B 10/02 244/3.1 |
| 5,971,875 | A | 10/1999 | Hill | |
| 6,478,700 | B2 | 11/2002 | Hartman | |
| 6,887,172 | B2 | 5/2005 | Arasmith | |
| 7,037,222 | B2 * | 5/2006 | Mizek | F42B 6/08 473/583 |
| 7,207,908 | B1 | 4/2007 | Gizowski | |
| 7,771,297 | B2 * | 8/2010 | Kuhn | F42B 6/08 473/583 |
| 8,506,431 | B2 | 8/2013 | Green et al. | |
| 2009/0163309 | A1 * | 6/2009 | Hawthorne | F42B 6/08 473/584 |
| 2010/0004078 | A1 * | 1/2010 | Flanagan | F42B 6/08 473/583 |

OTHER PUBLICATIONS

Robert McCoy, Modern Exterior Ballistics,1999, p. 237, Shifter Publishing, Ltd., Atglen, PA, USA.

Steven Brandt, et al, Introduction to Aeronautics: A Design Perspective, First Edition, 1997, p. 206, AIAA Education Series, Reston, VA, USA.

* cited by examiner

QUICK-DETACHABLE MULTI-PURPOSE ACCESSORY MOUNTING PLATFORM

CROSS REFERENCE TO RELATED APPLICATION

This application is a Continuation-in-Part of U.S. patent application Ser. No. 15/468,101 filed on Mar. 23, 2017, entitled "Quick-Detachable Multi-Purpose Accessory Mounting Platform," which claims the benefit of U.S. Provisional Patent Application Ser. No. 62/312,275 filed on Mar. 23, 2016, entitled "Devices and Tools for Improved Hunting," which are incorporated by reference in their entirety.

FIELD OF THE DISCLOSURE

The present disclosure generally relates to hunting mechanisms, and more particularly to a quick-detachable multi-purpose accessory mounting platform.

BACKGROUND

Various devices and tools are used in connection with hunting; however, as described herein, these devices and tools have various drawbacks that hinder the hunting experience and results thereof. Examples of some of the drawbacks of each device and tool are separately described.

Autonomous Trap Magazine

Shotgun shooters routinely utilize clay target throwing devices to hone skills necessary to hit moving targets while the targets are in flight. A variety of clay target throwing devices are available to the consumer ranging from hand-operated manual throwers to electrically driven autonomous traps which can launch multiple clay targets simultaneously. Lightweight, portable autonomous traps allow a single shooter the convenience of clay target shooting unaided by a helper, and this style of trap can be easily set-up quickly in the field to mimic specific shooting scenarios. Autonomy is aided by a remotely-located, push-button switch which, when pressed, cycles the trap to launch the clay target. A universal feature of autonomous traps is the hopper in which multiple clay targets are simultaneously stacked prior to the onset of the shooting session.

Each clay target in the stack is gravity fed into the trap separately and automatically, eliminating the need for the shooter to repeatedly reload the trap between shots and freeing the shooter from remaining near of the trap during a shooting session. In the case of portable autonomous traps, the hopper is typically disassembled for transportation and storage of the trap. At the shooting site, the hopper must be assembled and mounted onto the trap using hand tools prior to the trap's use. However, clay targets cannot be loaded into the hopper until the hopper is mounted on the trap.

Weathercocking Arrowhead

Broadhead arrowheads include several sharpened blades arranged circumferentially about an arrow tip and may be utilized extensively in the dispatching of medium and large game. In general, there are two types of broadhead arrowheads. The first type is a fixed-blade broadhead arrowhead, incorporating blades that are rigidly attached to the tip of the arrow. The blades of the fixed-blade broadhead arrowhead may be permanently attached to the arrow tip, or they may take the form of replaceable blade elements which can be individually replaced when damaged or dull. The main advantages of the fixed-blade broadhead arrowhead are simplicity and reliability. The main disadvantage of the fixed-blade broadhead arrowhead is that the maximum span of the blades must be kept relatively small to mimic flight characteristics of an arrow equipped with an axi symmetric field point arrow tip that has no blades. The latter is widely used in archery practice and training exercises. The second type of broadhead arrowhead is a mechanical broadhead arrowhead, and it generally may include blades that are held in a streamlined position when the arrow is launched and while in flight. Upon impact, the blades rotate radially outward from the central axis of the arrow to increase the effective span of the arrowhead during penetration and creation of the wound channel. One advantage of a mechanical broadhead arrowhead is that the maximum span of the expanded blades can be greatly increased over that of a fixed-blade broadhead arrowhead. A second advantage is that prior to impact, the blades remain in the closed position; therefore an arrow equipped with a mechanical broadhead arrowhead will closely mimic the flight characteristics of an arrow tipped with a field point arrowhead. However, these advantages come at the expense of mechanical complexity and system reliability. To be effective, the mechanical broadhead arrowhead must remain in the closed position during launch and flight and must also expand symmetrically and completely during the penetration event.

An examination of the relevant aerodynamics of an arrow in flight follows. An arrow can be described with respect to three major components: the tip, the shaft, and the fletching. During flight, an arrow is subject to disturbances (for instance, when launched from a poorly tuned bow) which may cause the arrow to oscillate about its center-of-gravity (cg) centrally located at a point on the shaft centerline between the tip and the fletching. As the arrow oscillates, a transverse force due to lift is generated at the tip that when multiplied by its distance forward of the cg produces a destabilizing overturning moment about the cg. Similarly, a transverse force generated by the fletching multiplied by its distance aft of the cg counteracts this destabilizing moment by providing a larger, corrective stabilizing moment about the cg in opposition to that generated by the tip. As long as the stabilizing moment is greater that the destabilizing moment, the arrow will tend toward self-correction, i.e., the central axis of the arrow will align with the intended flight path. Thus it becomes clear why a conventional fixed-blade broadhead arrowhead must be limited in blade span; the larger the blade span, the greater the destabilizing overturning moment produced and the less stable the arrow becomes. If the blade span becomes so large that the destabilizing moment produced forward of the cg is greater than the stabilizing moment produced aft of the cg, as the flight progresses, the arrow will increasingly deviate from the intended flight path.

Smoothbore Shotgun Slug

Slugs designed to be fired from a smoothbore shotgun barrel are typically less accurate than slugs designed to be fired from a shotgun having a rifled bore. Several reasons exist for the inaccuracy of slugs fired from smoothbore barrels. One major reason for the inaccuracy is that the smoothbore slug typically lacks adequate static margin, which can be defined as: $(Xcp-Xcg)/L*100\%$, where Xcg is the axial location of the center of gravity measured from the nose of the projectile, Xcp is the axial center-of-pressure also measured from the projectile's nose, and L is the axial length of the projectile. If the static margin is small or negative (for example, less than 5%), the projectile can easily be diverted from the intended shot line due to a lack of longitudinal stability. Small static margin values are inherent in slugs intended for a smoothbore shotgun barrel, as these slugs are low in aspect ratio and cylindrical in form, and this form does not accommodate means for shifting of the center of pressure rearward as required for increased stability. In addition to limited static margin, another major reason for the inherent inaccuracy of a slug fired from a smoothbore barrel is that no roll moment, or an inconsistent roll moment, is imparted to the slug. Induced rolling reduces impact dispersion by averaging out asymmetric forces imposed on slug during launch and while in flight.

To increase accuracy, many shotguns intended for sporting purposes originally fitted with a smoothbore barrel can be retrofitted with a rifled-bore barrel; however, the cost of the rifled-bore barrel can be of the same order as that of the original shotgun. Along with the cost, another downside to installing a rifled shotgun barrel is that the shotgun then becomes a special purpose firearm intended for use against medium to large game, thus limiting the type of game that can be pursued during an outing in the field. Even though smoothbore shotgun slugs are less accurate, they have the advantage that usually no alterations to the shotgun are necessary. This allows a shotgun having a smoothbore barrel to retain the flexibility of taking both small and large game merely by changing ammunition.

Quick-Detachable Multi-Purpose Accessory Mounting Platform

When hunting with a firearm, it is convenient to have accessories such as a flashlight, infrared spotlight, and/or a remote dog training transmitter easily at hand. This can be accomplished by mounting accessories on the firearm within easy reach of the shooter's non-trigger hand, and in an orientation that allows for immediate operation during the act of both carrying and shooting the gun. Furthermore, conditions such as weather, terrain, intended quarry, day/night or night/day transitions, etc. may change during a hunt. The ability to quickly attach or detach various accessories from the firearm, or to quickly attach or detach the entire mounting platform (with the accessories remaining attached to the platform) allows the hunter to better adapt to the changing conditions. Quick-detach firearm-mounted accessories are in common use for military-style firearms which routinely include features such as integrated Picatinny rails for that purpose. However, in contrast to military-style firearms, firearms intended for sporting use are typically not factory-equipped with mounting points for such accessories.

Glock Magazine Release Button Removal Tool

The as-issued magazine release button on a Glock pistol is often replaced, or in the case of left-handed shooters, reversed, to offer the shooter better operational characteristics when changing magazines. The button is usually operated by pressing inward with the thumb of the shooter's dominant hand, with the motion of the button being transverse to the line of fire. The standard button head on a Glock pistol is relatively small and mounted nearly flush with the frame surface such that operation of the button under stress or during extended training sessions can become difficult. Aftermarket replacement buttons typically offer increased button head surface area, and they may increase the operational travel via greater offset of the button head from the frame.

The release button is held in the frame by a vertically oriented, cantilevered, straight steel rod spring inset into a "V" shaped cavity located in the forward face of the pistol frame's magazine well. The fixed end of the spring is held captive by the cavity walls at the narrow end of the cavity near the bottom of the magazine well. The free end of the spring is located higher up in the magazine well where the wider end of the "V" shaped cavity allows room for the free end of the spring to travel side-to-side. The free end of the spring is contained within a slot in the magazine release button which has an opening near one end to allow the installation of the spring' s free end into the slot. The free end of the spring elastically bends side-to-side to initially resist the motion of the release button when depressed, and to return the release button to its original position when released.

Removal of the free end of the spring from the slot in the magazine release button occurs to replace or reverse the release button. Flat-bladed screw drivers and dental picks are common impromptu tools which are used to manipulate the free end of the spring toward, and out of the open end of the slot. Access to the spring can only be had through the top or the bottom of the magazine well, which severely limits access to the spring, and causes poor purchase between the impromptu tool and the side of the spring. In many instances, damage to the polymer frame occurs when the impromptu tool slips away from the spring and strikes the edge of the molded spring cavity; the resultant burrs raised on the inside of the magazine well can adversely affect the release and retention of the magazine.

SUMMARY

Embodiments of the present disclosure may provide various devices and tools that may be used in connection with hunting, and certain devices and tools may improve the hunting experience and results thereof. These devices and tools may include an autonomous trap magazine, a weathercocking arrowhead, a smoothbore shotgun slug, a quick-detachable multi-purpose accessory mounting platform, and a Glock magazine release button removal tool.

Some embodiments of the present disclosure may provide a multi-purpose accessory mounting platform comprising: a split barrel clamp positioned parallel to a split ventilated rib clamp; an integral hinge that extends between a face of the split barrel clamp and a face of the split ventilated rib clamp; and one or more thumb screws and one or more threaded inserts that mate together to secure the platform to an object via the split barrel clamp and the split ventilated rib clamp. The platform may further comprise at least one recessed circumferentially arranged mounting pad extending over but not contacting the forearm of the firearm that may provide a location for one or more accessories to be attached to the platform. The one or more accessories may be attached to the platform via hook and loop type fasteners or Picatinny rail sections. The platform may further comprise one or more surfaces along split barrel clamp and the split ventilated rib clamp to provide one or more additional accessory mounting points. The platform also may comprise a rear shelf integrally attached to a rear end of the platform. The rear shelf may further include one or more shelf flats oriented parallel to a face of the at least one recessed circumferentially arranged mounting pad. The platform may be formed from one or more materials selected from the group comprising: styrene, urethane, and polyester. The platform may be manufactured using one or more of the following techniques: plastic molding and 3D printing technology. The at least one recessed circumferentially arranged mounting pad may also include one or more central mounting slots located at a forward end of the at least one recessed circumferentially arranged mounting pad.

Further embodiments of the present disclosure may provide a multi-purpose accessory mounting platform comprising: at least one clamp to receive at least one object; and at least one flat mounting surface attached to the at least one clamp, wherein one or more accessories are mounted to the at least one flat mounting surface using adhesive-backed hook and loop type fasteners or Picatinny rail sections. The at least one clamp may be a friction clamp. The platform may further comprise at least one recessed mounting pad, wherein one or more accessories may be mounted to the recessed mounting pad using adhesive-backed hook and loop type fasteners. The platform also may comprise at least one upper tie down post and at least one lower tie down post to secure at least one accessory via elastic bands laced around the at least one upper tie down post and the at least one lower tie down post.

Additional embodiments of the present disclosure may provide a multi-purpose accessory mounting platform for attachment to a firearm, the platform comprising: at least one clamp that receives a muzzle of the firearm; one or more fasteners that mate together to secure the platform to the firearm via the at least one clamp; at least one recessed attachment pad to secure at least one accessory; and at least one mounting surface to secure at least one accessory. The platform also may include a portal that may receive a sling of the firearm. The at least one clamp may be a barrel clamp and a ventilated rib clamp. The platform may further include at least one shelf that may provide a pivot point for initial alignment of the firearm when being attached to the platform. The one or more fasteners may be one or more thumb screws and one or more threaded inserts. The one or more fasteners may be a plurality of disc-shaped magnets. The at least one recessed attachment pad may further comprise one or more central mounting slots located at a forward end of the at least one recessed attachment pad.

BRIEF DESCRIPTION OF THE DRAWINGS

For a more complete understanding of this disclosure, reference is now made to the following description, taken in conjunction with the accompanying drawings, in which.

Autonomous Trap Magazine

Weathercocking Arrowhead

Figure 9A:
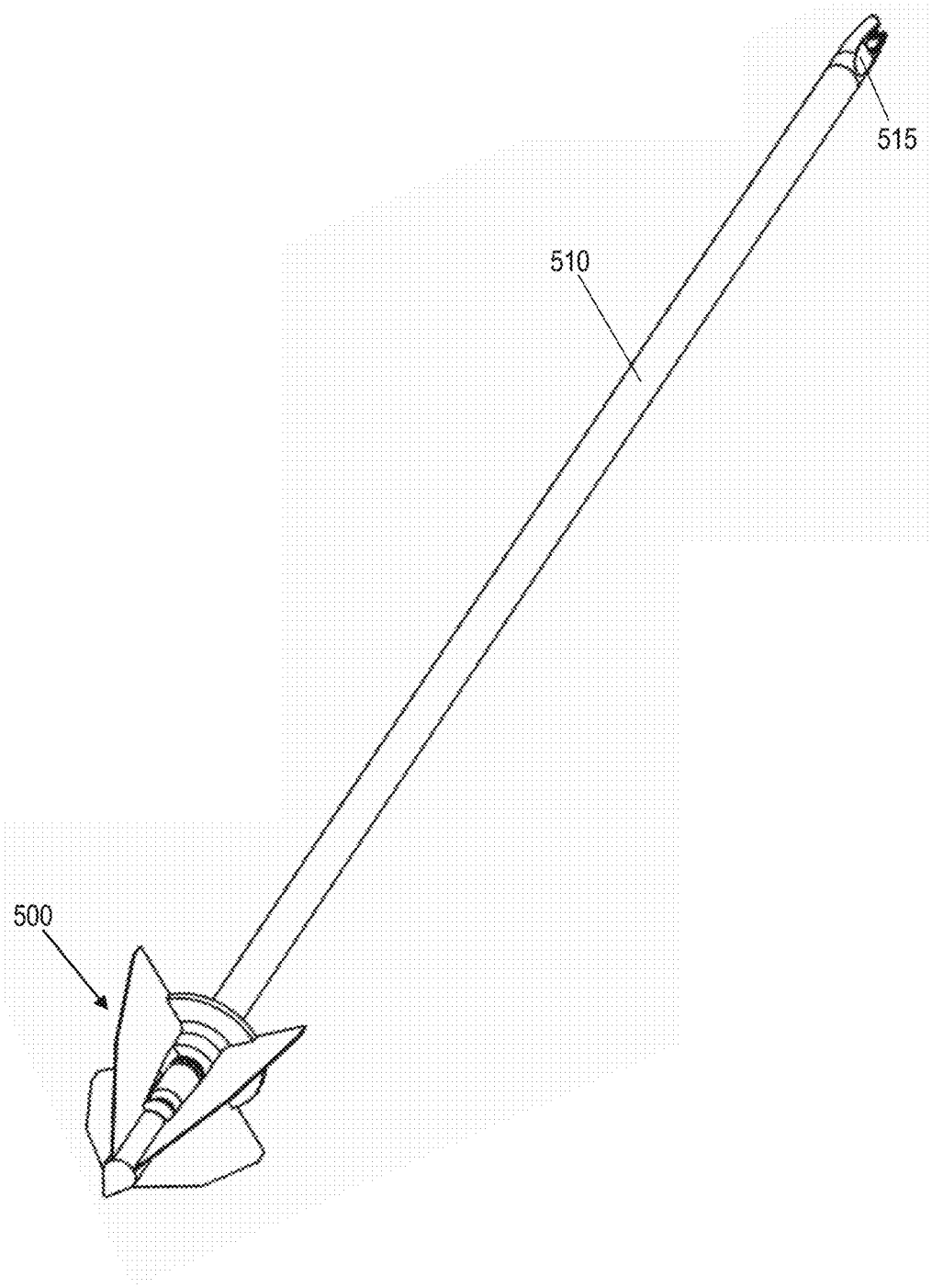
Figure 9B:
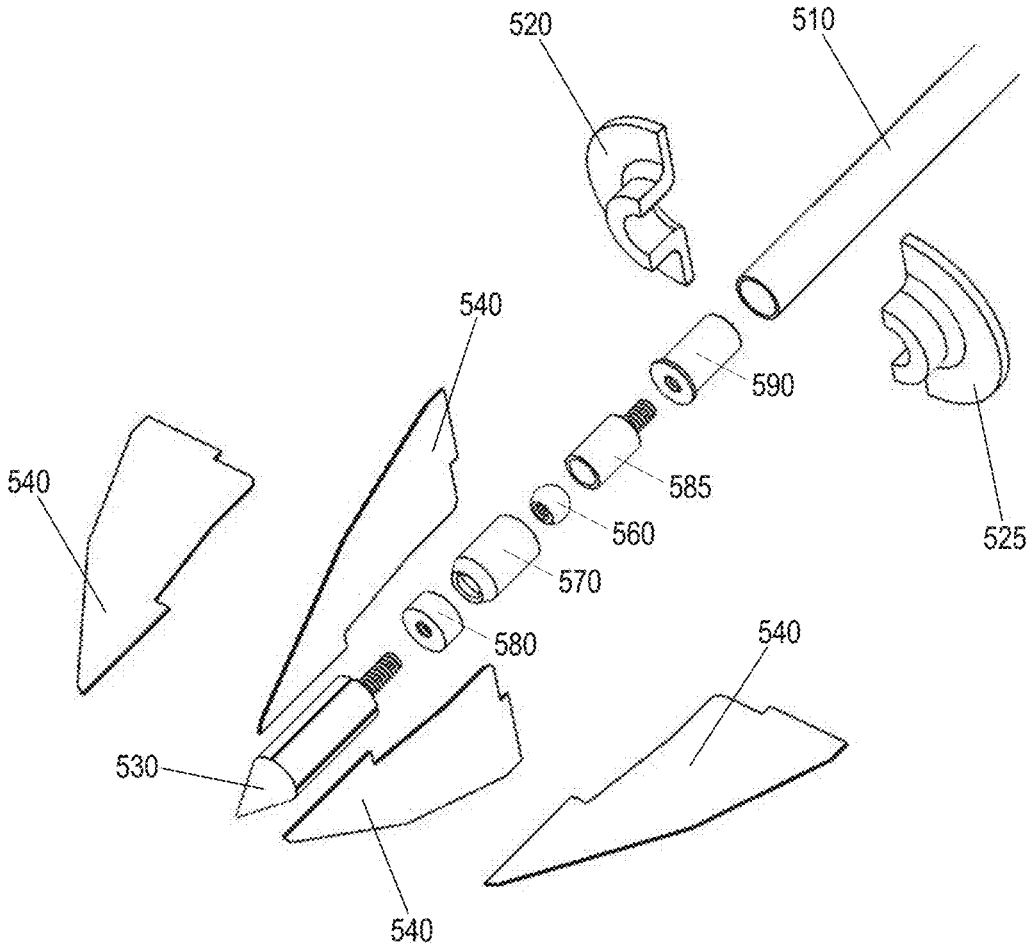
Figure 10A:
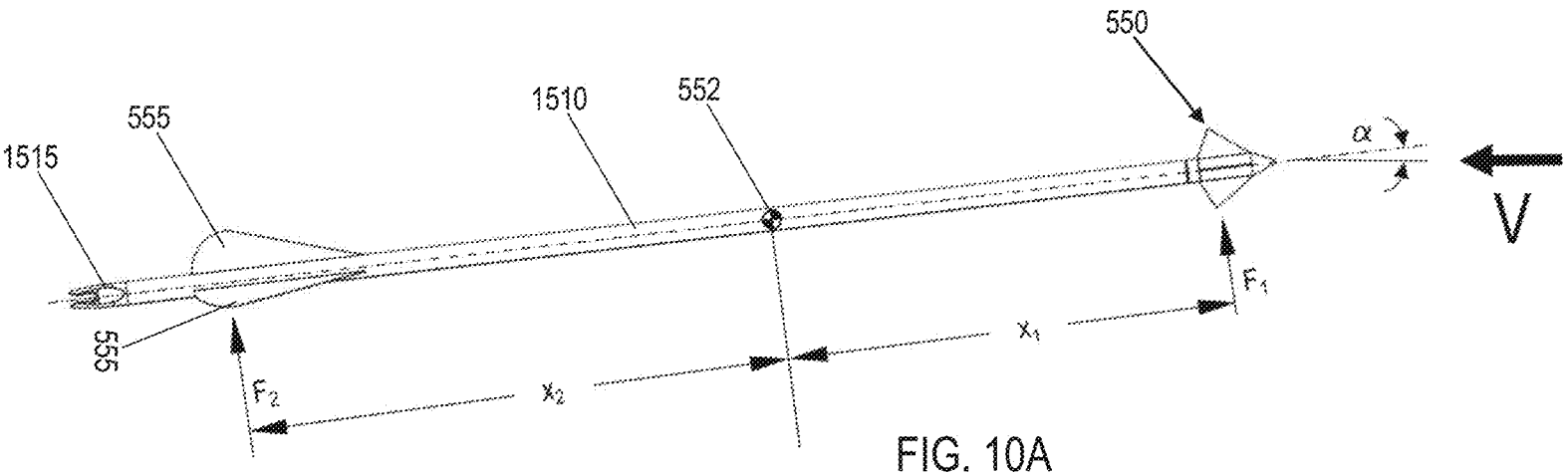
FIG. 10A PRIOR ART
Figure 10B:
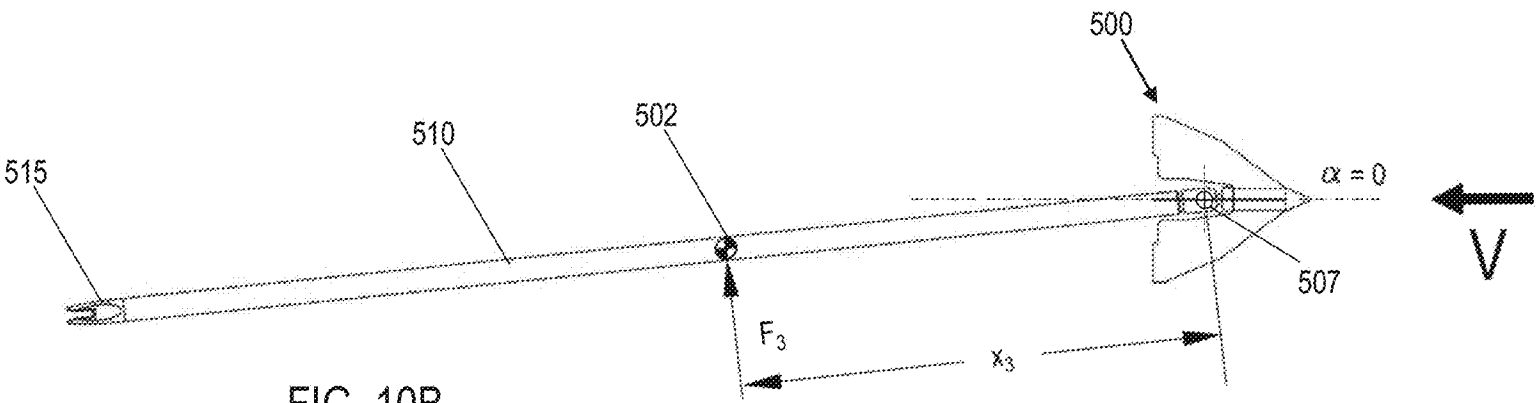
Figure 10C:
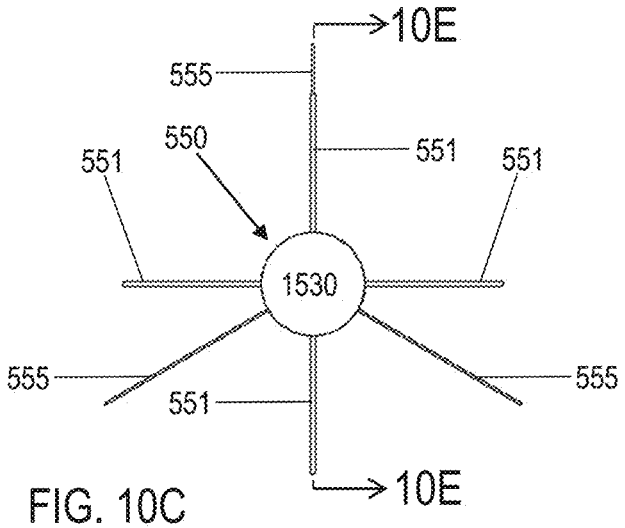
FIG. 10C PRIOR ART
Figure 10D:
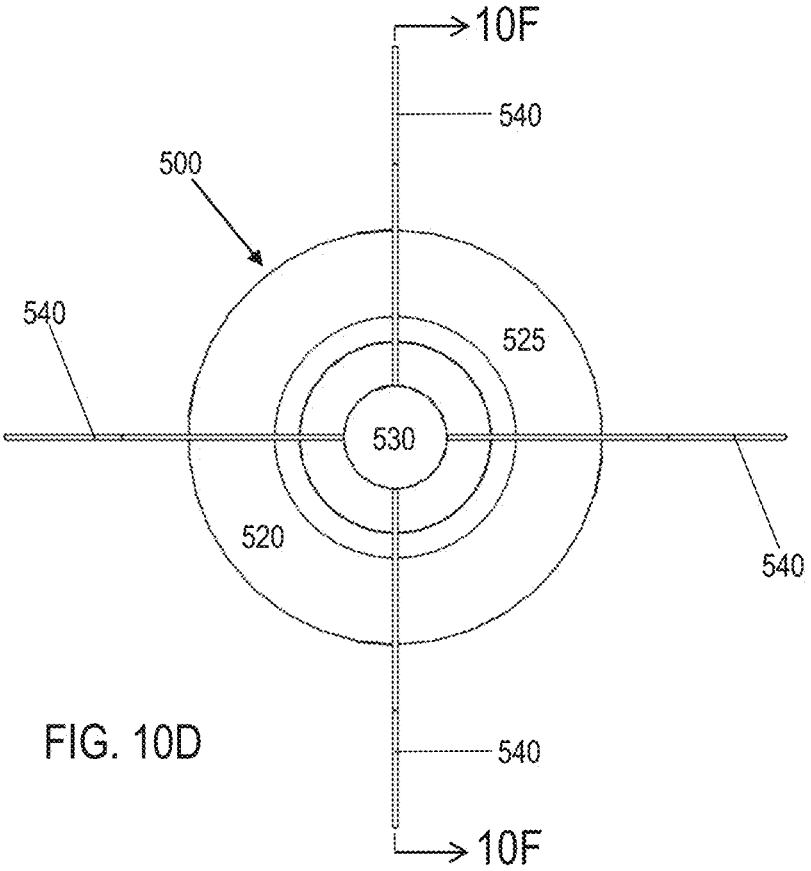
Figure 10E:
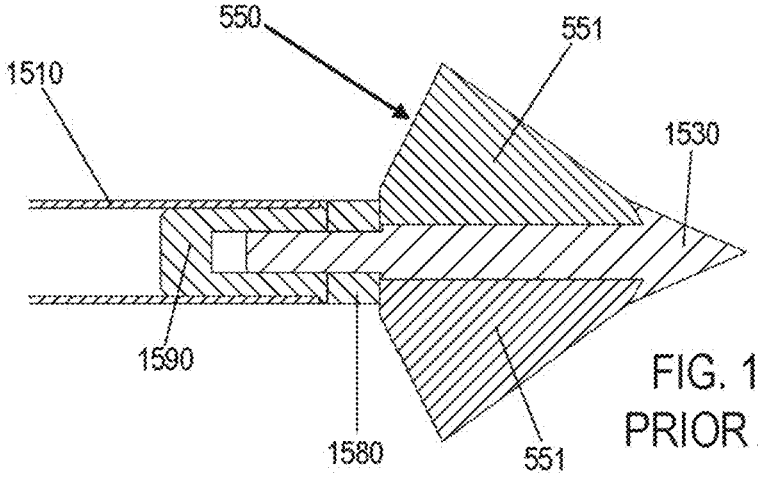
FIG. 10E PRIOR ART
Figure 10F:
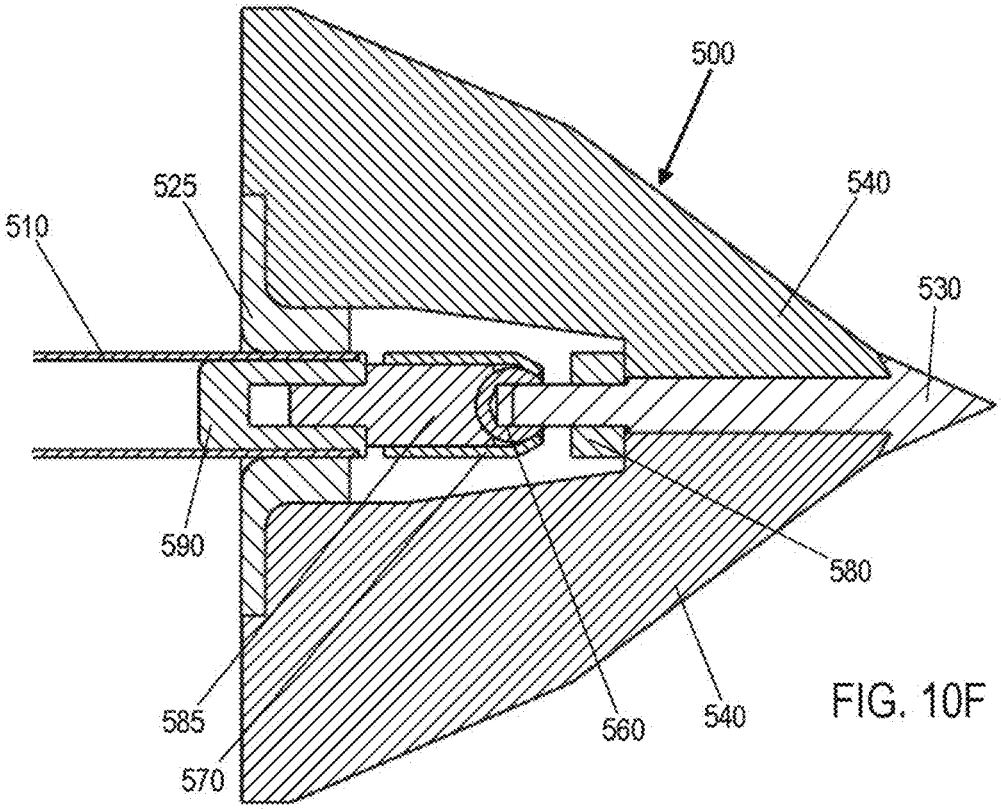
Figure 10G:
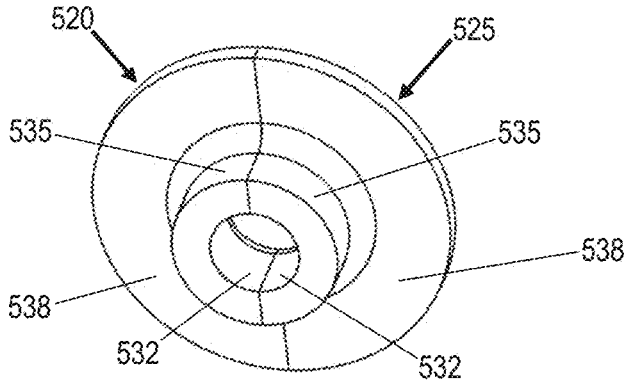
Figure 10H:
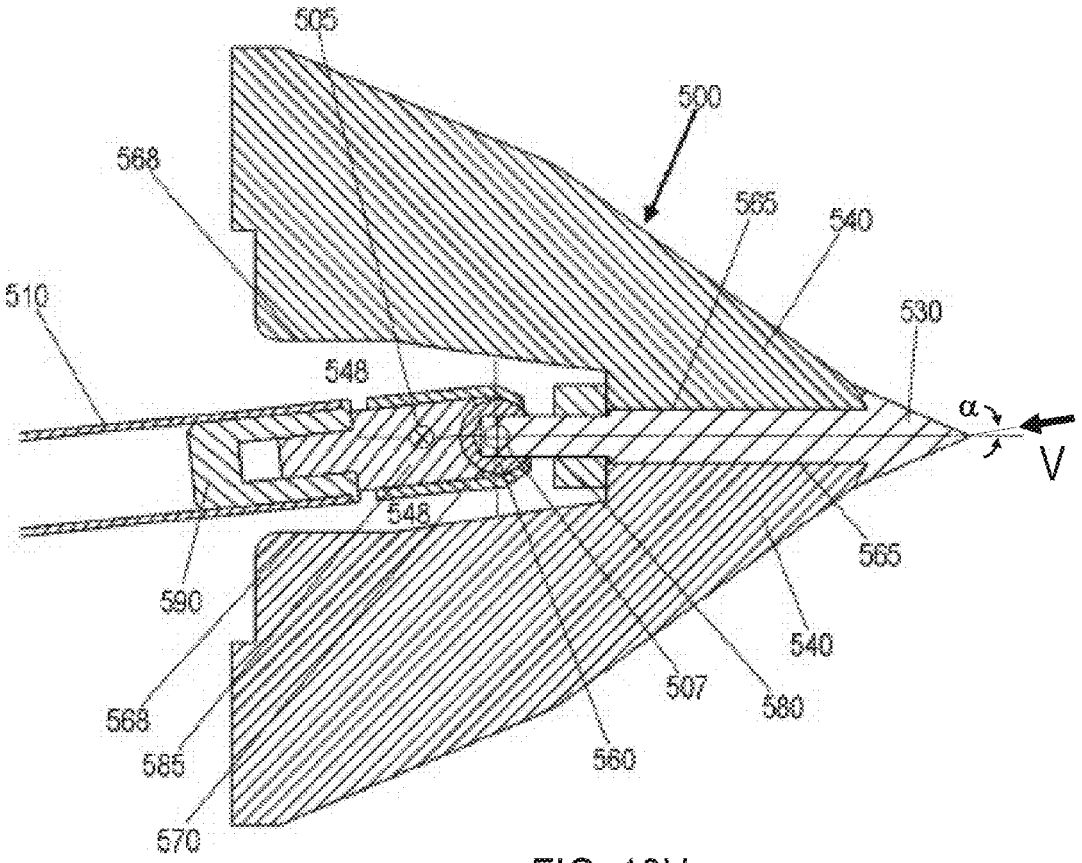
Figure 10I:
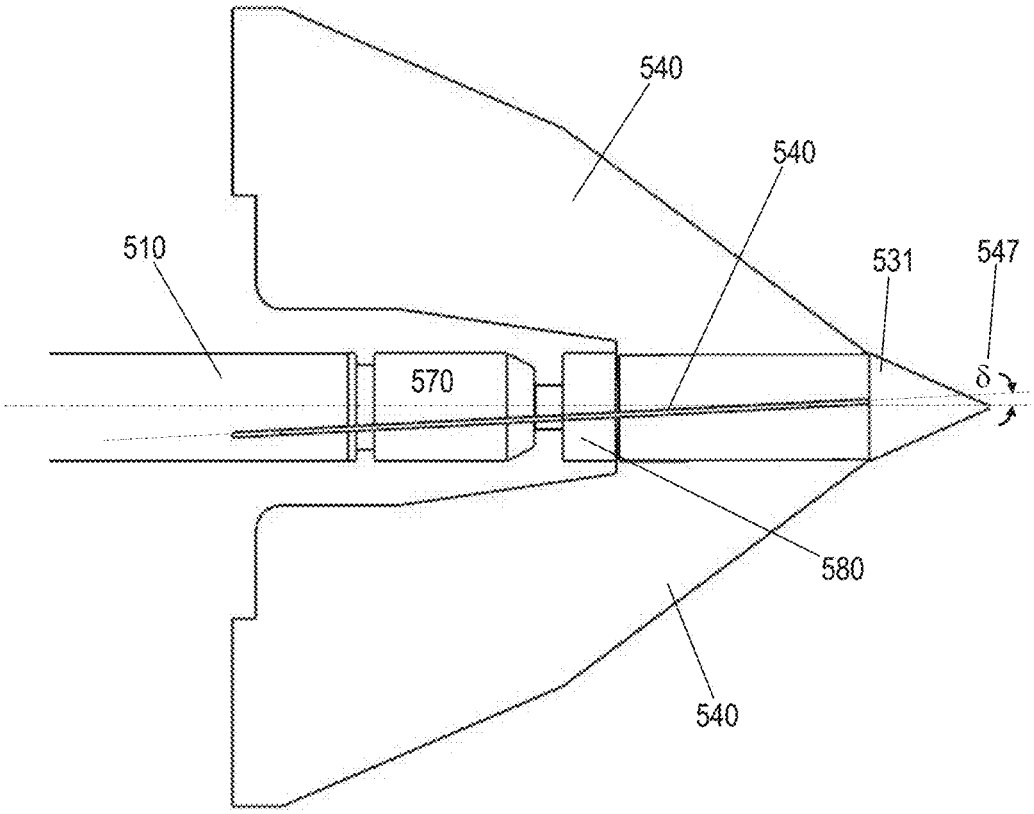
Figure 10J:
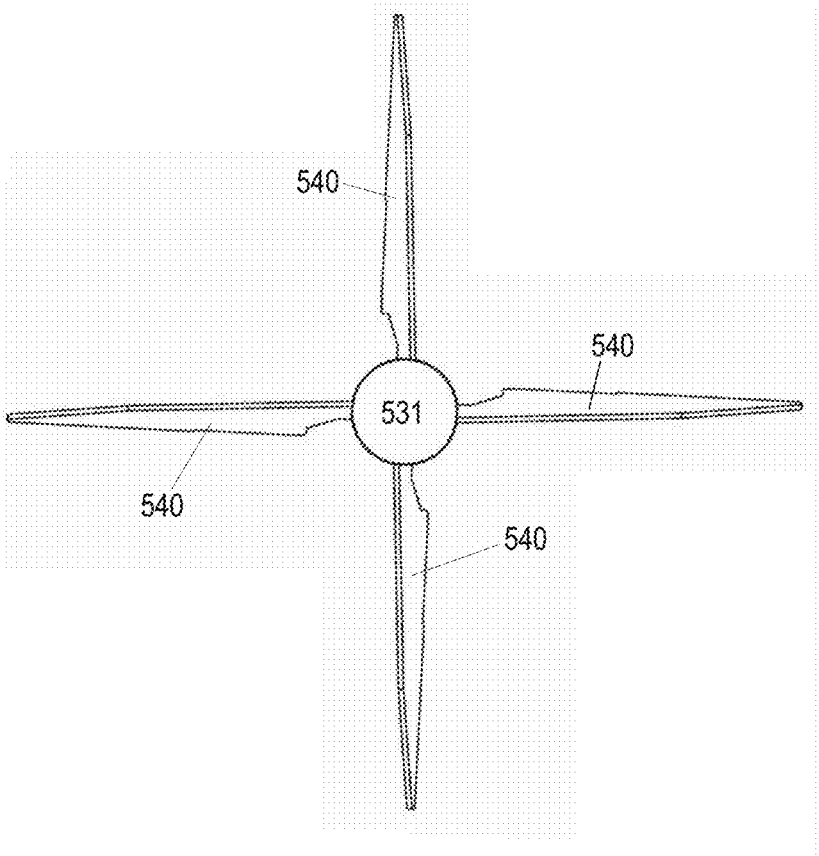
Figure 10K:
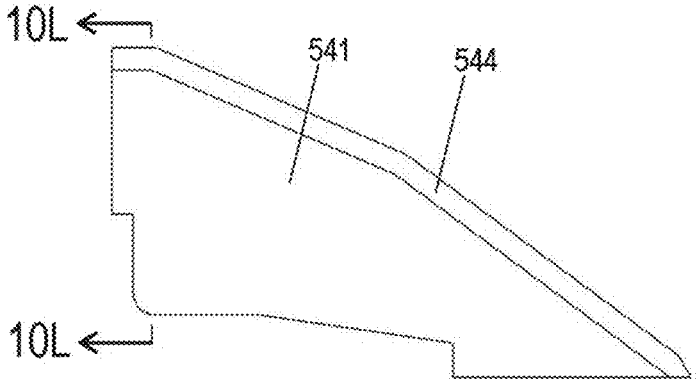
Figure 10L:
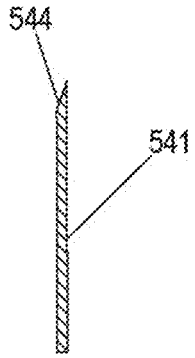
Figure 10M:
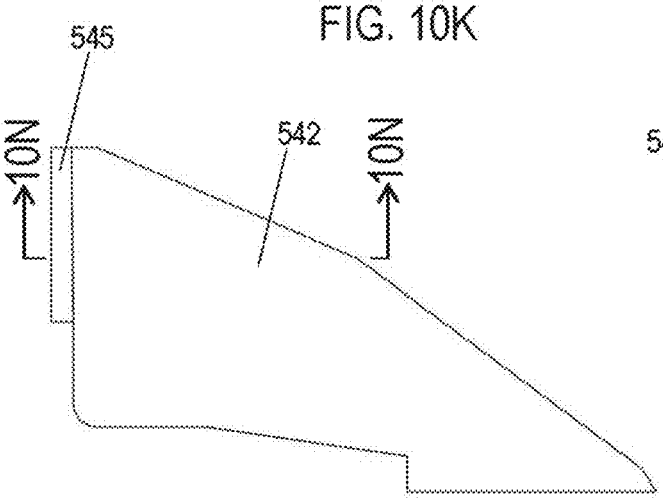
Figure 10N:
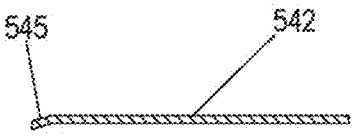
Figure 10O:
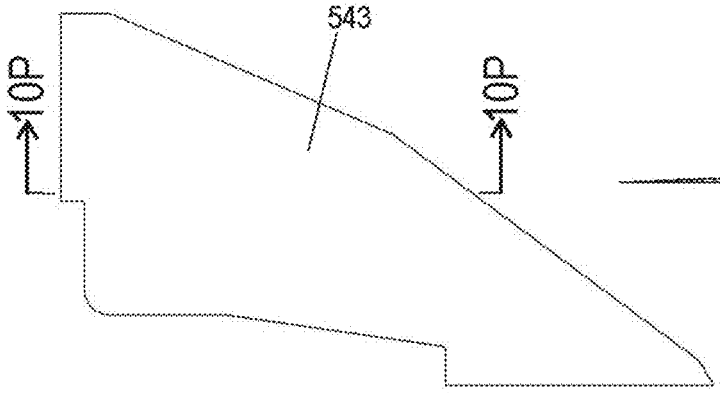
Figure 10P:
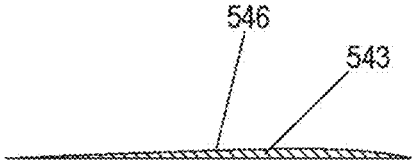

FIG. 9A depicts a perspective view taken from the user's right side of a weathercocking broadhead arrowhead constructed in accordance with embodiments of the present disclosure;

FIG. 9B depicts an exploded perspective view taken from the user's right side of a weathercocking broadhead arrowhead constructed in accordance with the embodiments of the present disclosure;

FIG. 10A depicts a right side view of a prior art broadhead arrowhead;

FIG. 10B depicts a right side view of a broadhead arrowhead according to an embodiment of the present disclosure;

FIG. 10C depicts a front view of a prior art broadhead arrowhead;

FIG. 10D depicts a front view of a broadhead arrowhead according to an embodiment of the present disclosure;

FIG. 10E depicts a left side cutaway view of a prior art broadhead arrowhead;

FIG. 10F depicts a left side cutaway view of a broadhead arrowhead according to an embodiment of the present disclosure;

FIG. 10G depicts a left side cutaway view of a broadhead arrowhead according to an embodiment of the present disclosure;

FIG. 10H depicts a left side cutaway view of a broadhead arrowhead according to an embodiment of the present disclosure;

FIG. 10I depicts a left side view of a broadhead arrowhead according to an embodiment of the present disclosure;

FIG. 10J depicts a front view of a broadhead arrowhead according to an embodiment of the present disclosure;

FIG. 10K depicts a left side view of a broadhead arrowhead blade according to an embodiment of the present disclosure;

FIG. 10L depicts a front cutaway view of a broadhead arrowhead blade according to an embodiment of the present disclosure;

FIG. 10M depicts a left side view of a broadhead arrowhead blade according to an embodiment of the present disclosure;

FIG. 10N depicts a bottom cutaway view of a broadhead arrowhead blade according to an embodiment of the present disclosure;

FIG. 10O depicts a left side view of a broadhead arrowhead blade according to an embodiment of the present disclosure; and FIG. 10P presents a bottom cutaway view of a broadhead arrowhead blade according to an embodiment of the present disclosure.

Smoothbore Shotgun Slug

Figure 11:
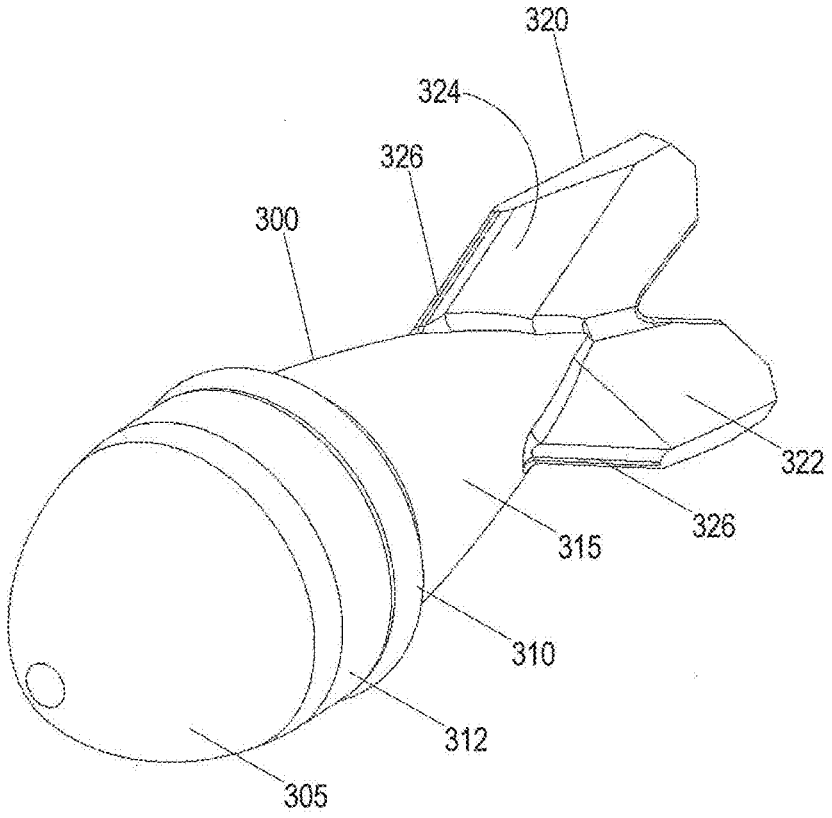
Figure 12:
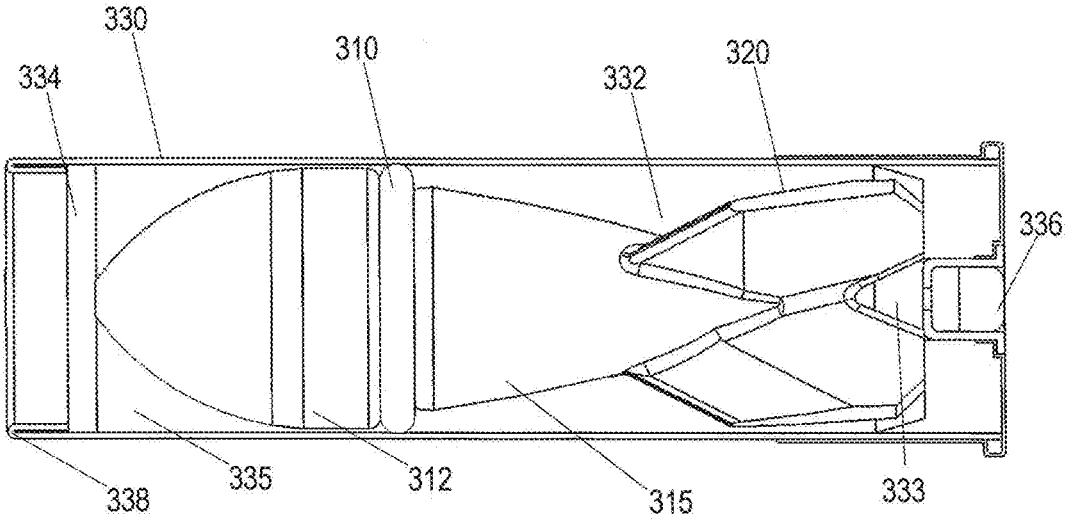
Figure 13:
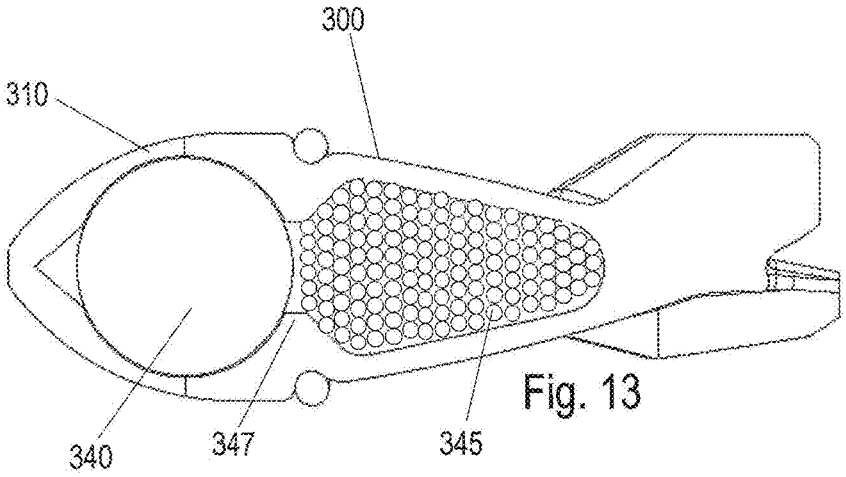
Figure 14:
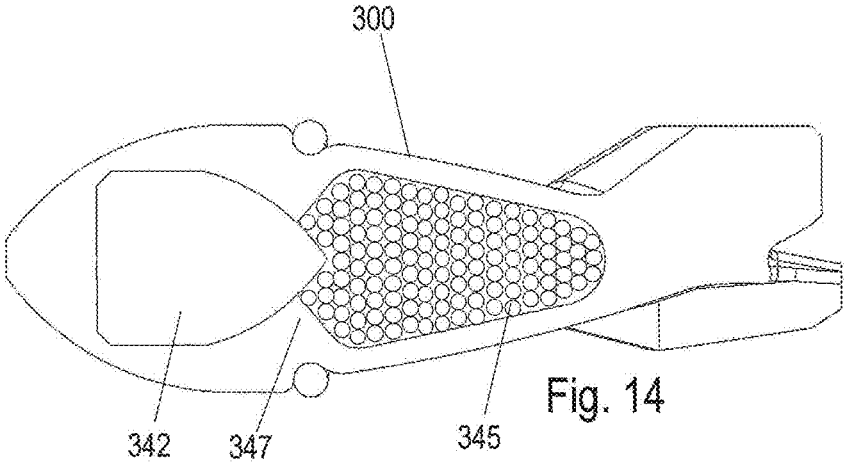
Figure 15:
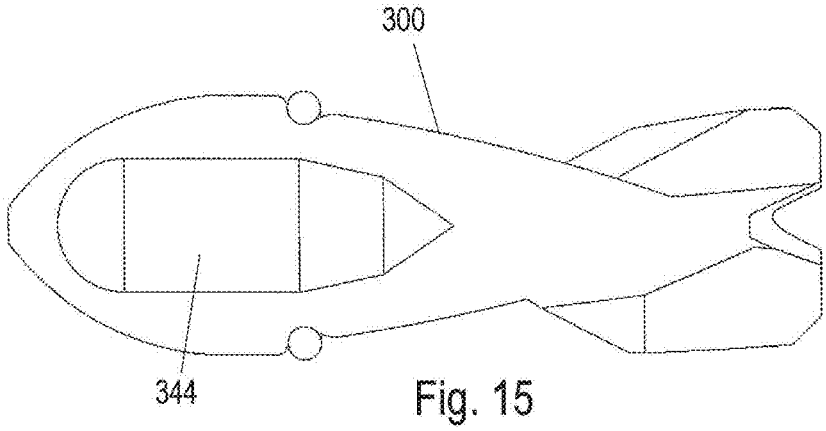
Figure 16:
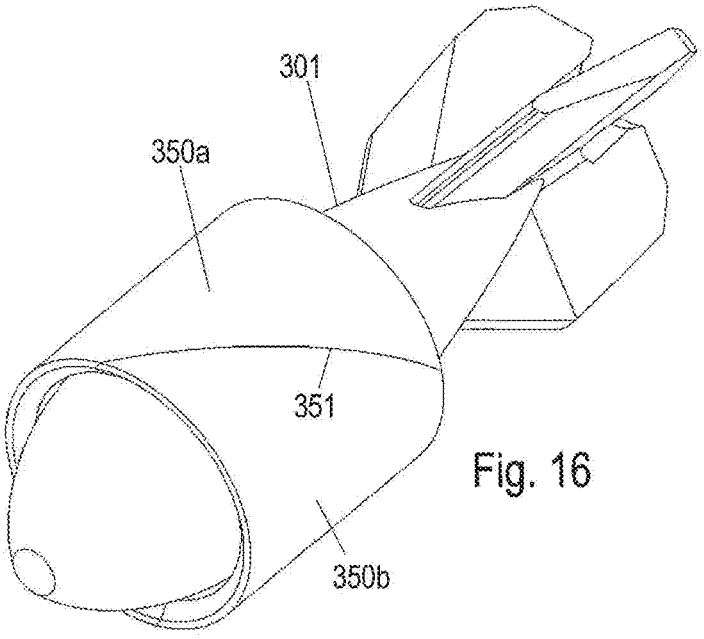
Figure 17:
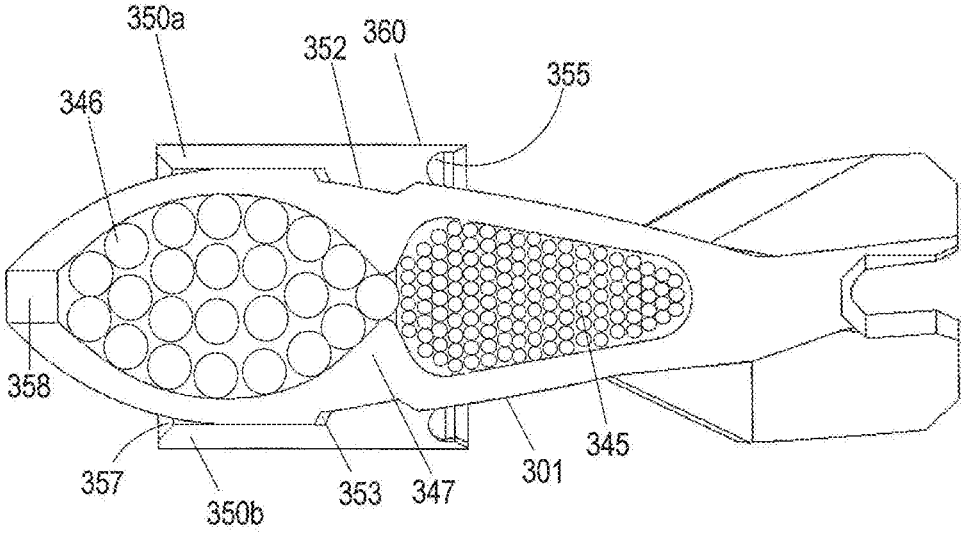

FIG. 11 depicts a front perspective view taken from the user's right side of a slug designed to be launched from a smoothbore shotgun barrel according to an embodiment of the present disclosure;

FIG. 12 depicts a side view of a slug body shown as a component in a side section view of a cylindrical shotgun shell in the assembled state according to an embodiment of the present disclosure;

FIG. 13 depicts a side section view of a slug body showing one embodiment of the present disclosure;

FIG. 14 depicts a side section view of a slug body showing another embodiment of the present disclosure;

FIG. 15 depicts a side section view of a slug body showing another embodiment of the present disclosure;

FIG. 16 depicts a front perspective view of a slug body showing another embodiment of the present disclosure; and FIG. 17 depicts a side section view of a slug body showing the right and left halves of the fully split obturator seal with a ramped interface between the obturator seal and the slug body according to an embodiment of the present disclosure.

Quick-Detachable Multi-Purpose Accessory Mounting Platform

Figure 18A:
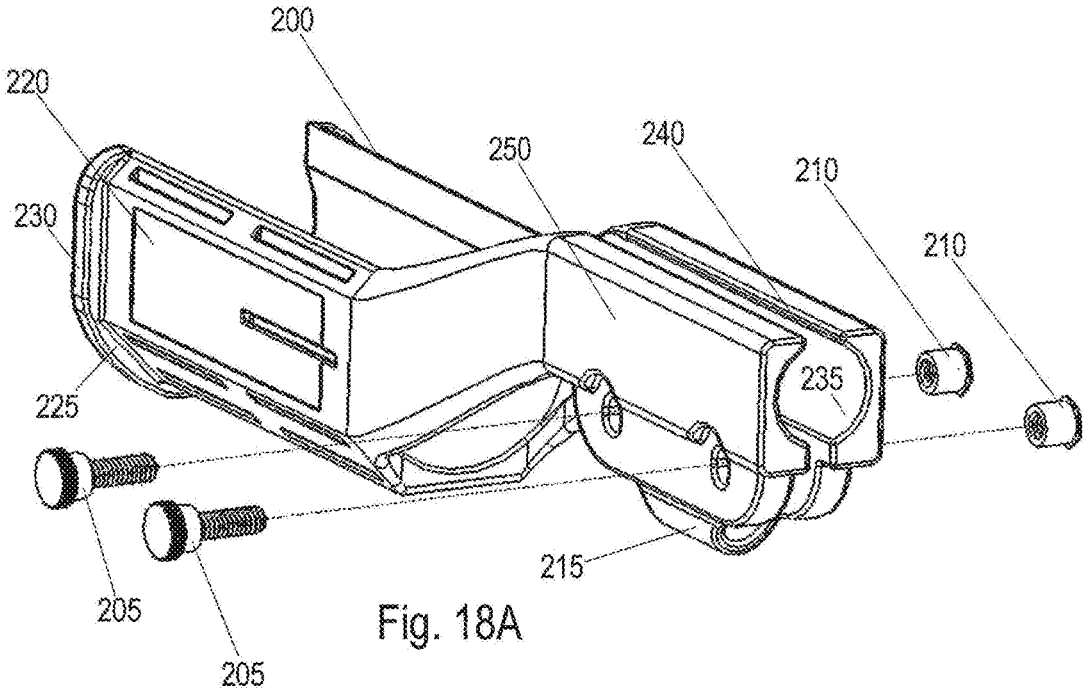
Figure 18B:
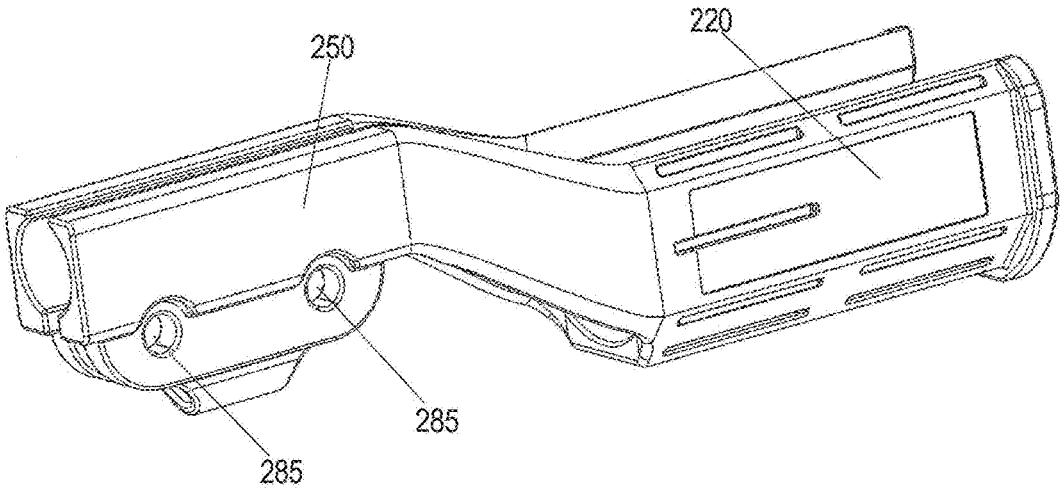
Figure 19:
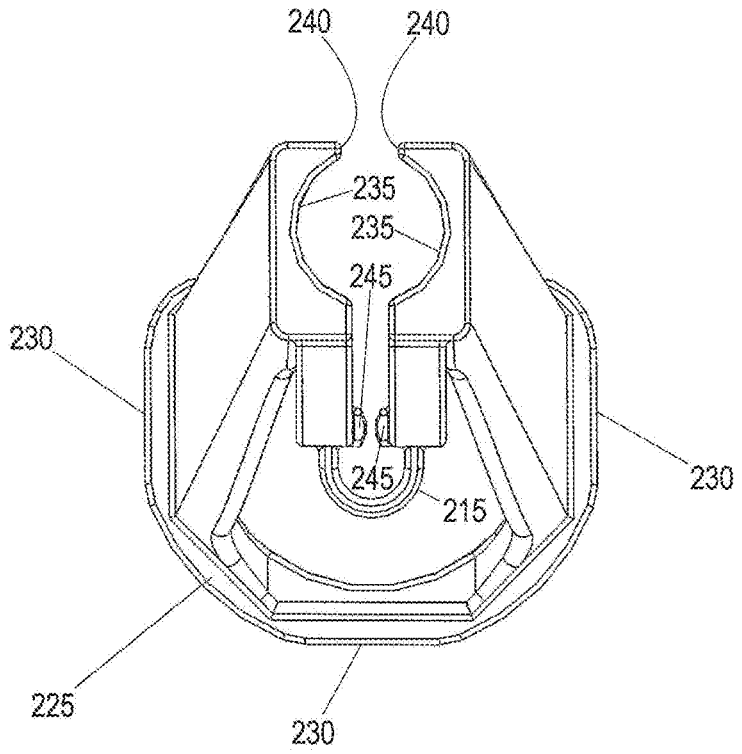
Figure 20A:
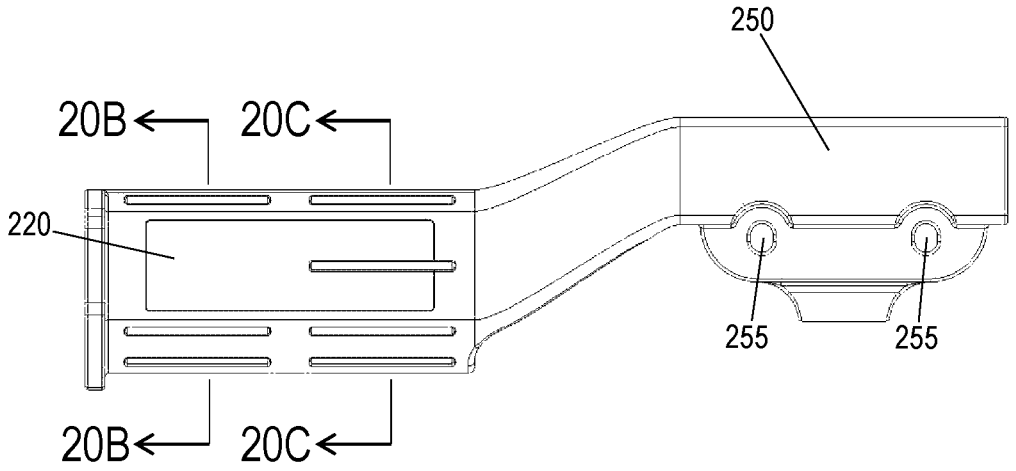
Figure 20B:
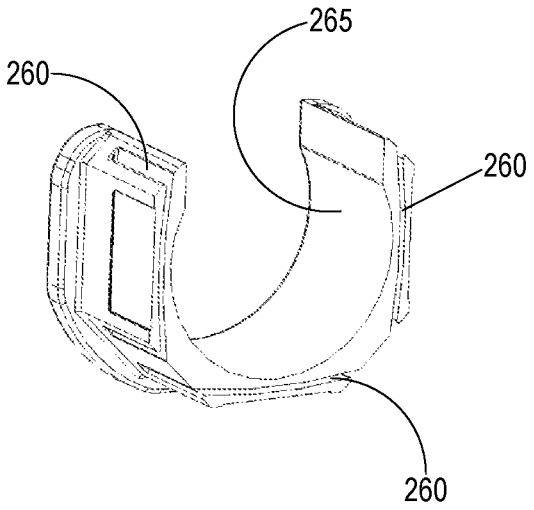
Figure 20C:
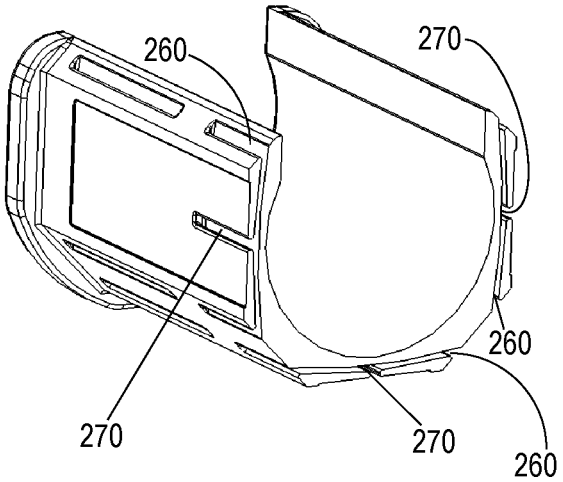
Figure 21A:
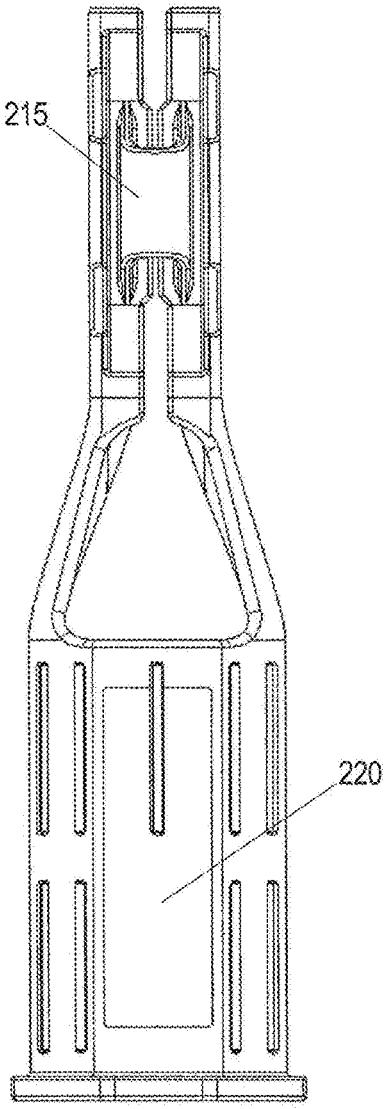
Figure 21B:
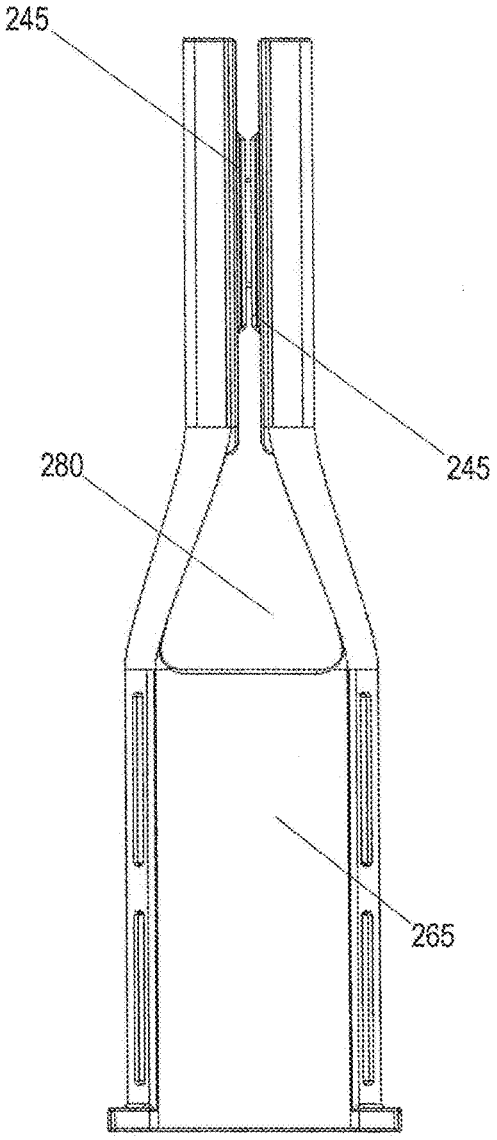
Figure 22:
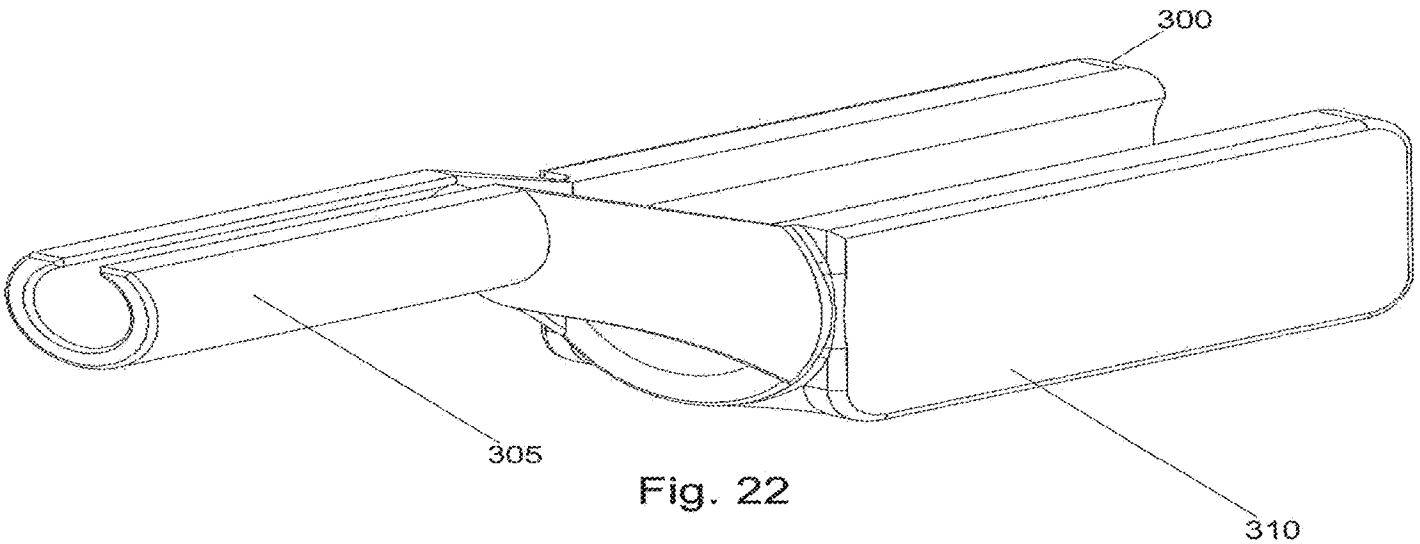
Figure 23:
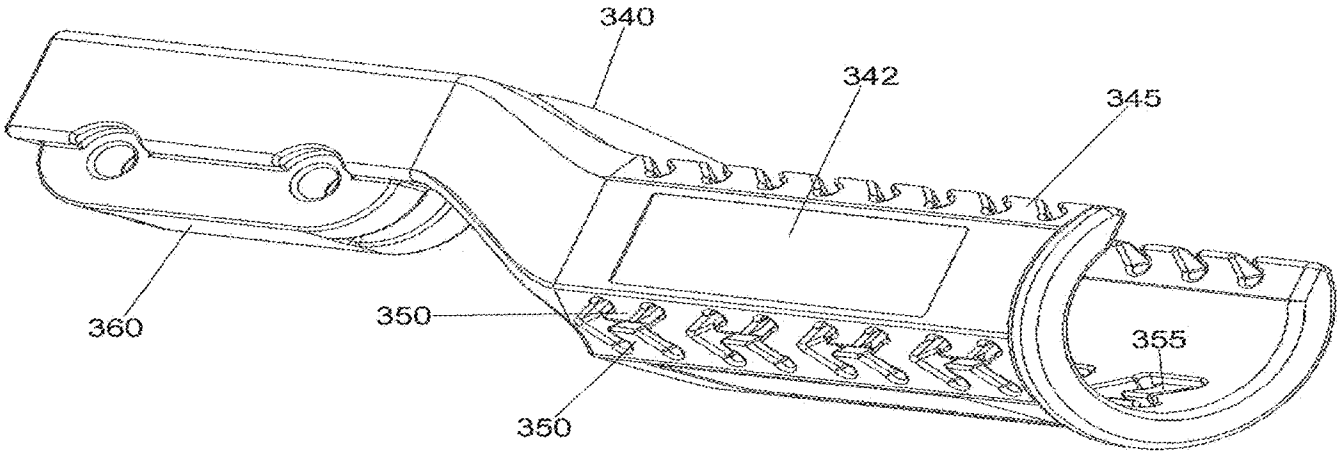
Figure 24:
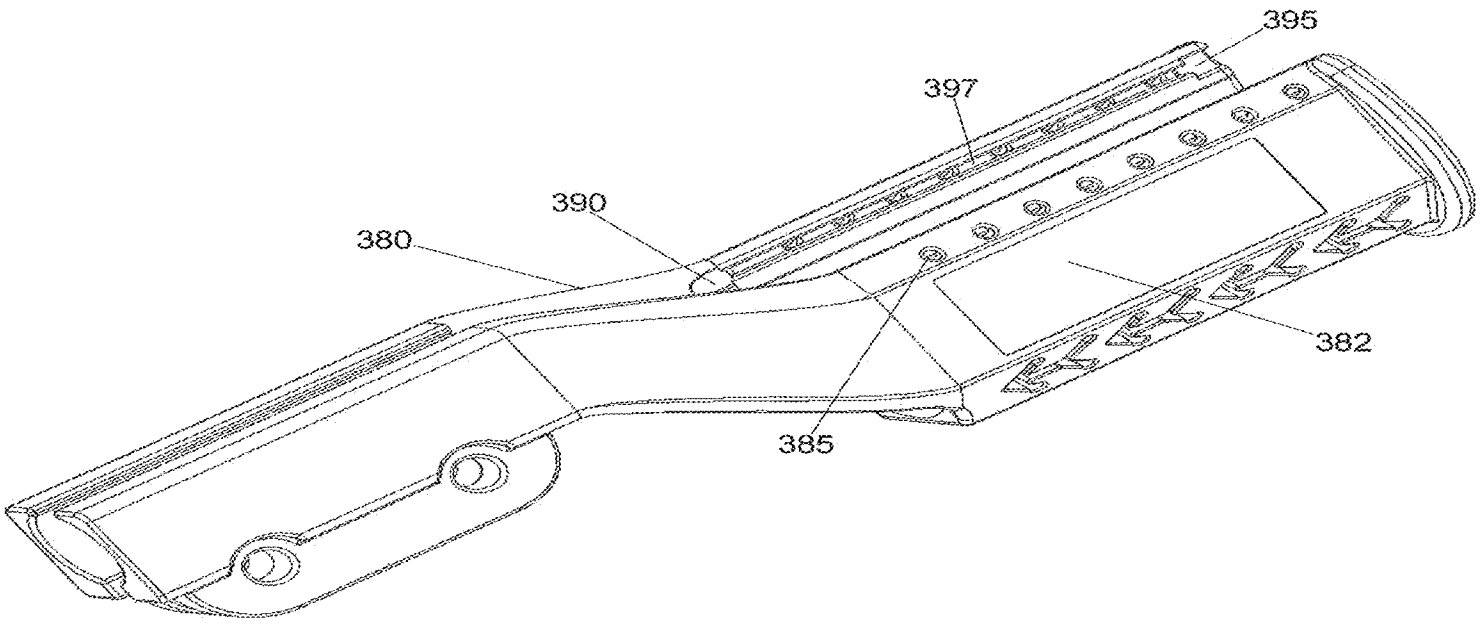
Figure 30:
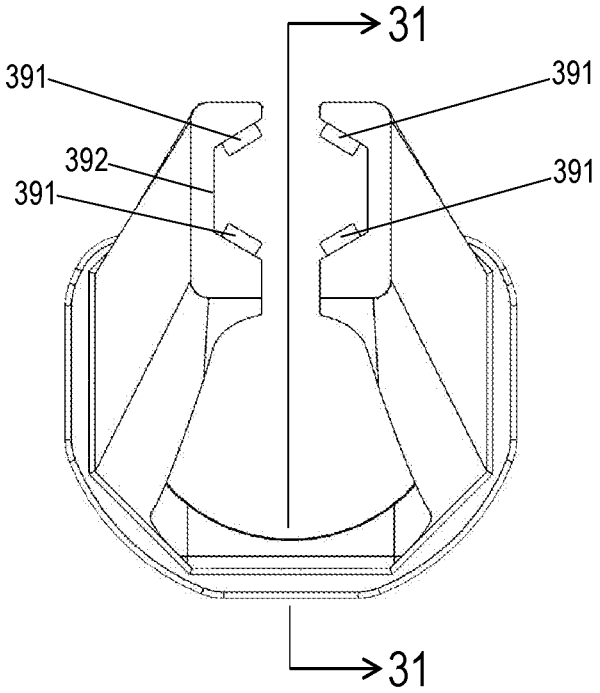
Figure 31:
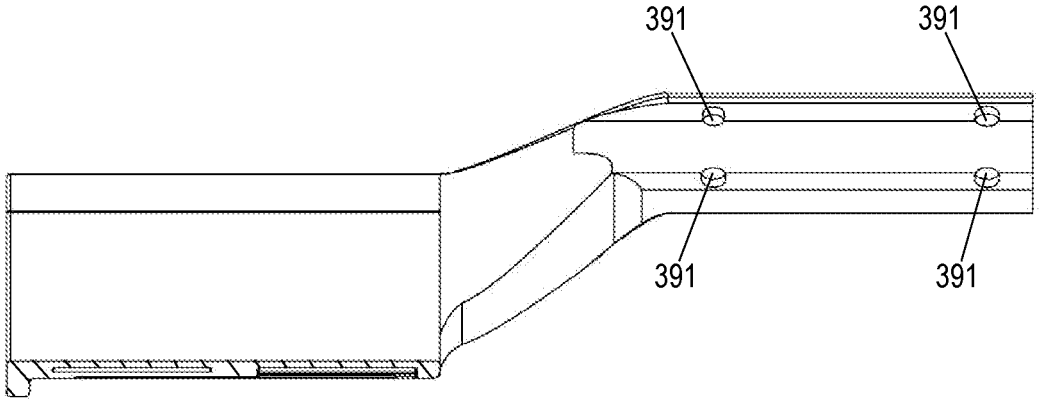

FIG. 18A depicts a perspective view taken from the user's right side of a multi-purpose accessory mounting platform according to an embodiment of the present disclosure;

FIG. 18B depicts a left perspective view of the platform, showing left-side mounting pad and left-side surface according to an embodiment of the present disclosure;

FIG. 19 depicts a front view of the platform according to an embodiment of the present disclosure;

FIG. 20A depicts a right side view of the platform, showing right side accessory mounting pad and right side mounting surface according to an embodiment of the present disclosure;

FIG. 20B depicts a cutaway perspective view showing the orientation of mounting slots according to an embodiment of the present disclosure;

FIG. 20C depicts a cutaway perspective view showing the location and geometry of central mounting slots according to an embodiment of the present disclosure;

FIG. 21A depicts a bottom view showing the orientation of a third mounting pad according to an embodiment of the present disclosure;

FIG. 21B depicts a top view of the mounting platform according to an embodiment of the present disclosure;

FIG. 22 depicts a left side perspective view showing an alternate embodiment of a multi-purpose accessory mounting platform;

FIG. 23 depicts a left side perspective view showing another embodiment of a multi-purpose accessory mounting platform for sporting guns;

FIG. 24 depicts a left side perspective view showing yet another embodiment of a multi-purpose accessory mounting platform for sporting guns;

FIG. 30 depicts a front view of a multi-purpose accessory mounting platform according to an embodiment of the present disclosure; and FIG. 31 depicts a side view of a multi-purpose accessory mounting platform according to an embodiment of the present disclosure.

Glock Magazine Release Button Removal Tool

Figure 25:
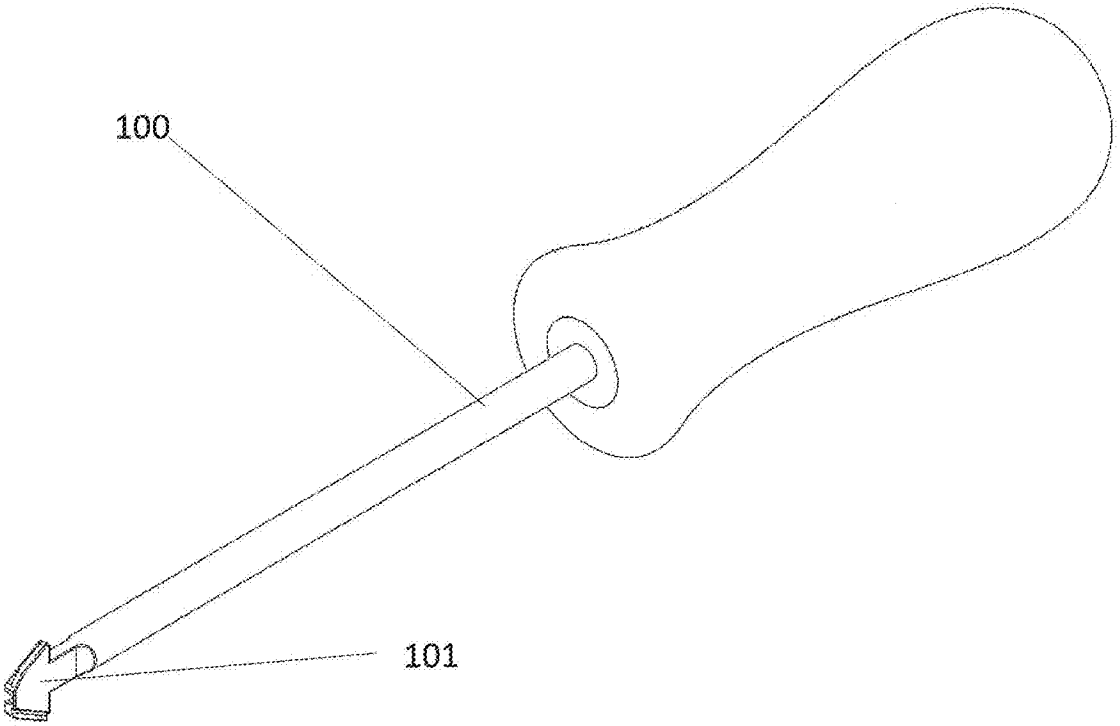
Figure 26:
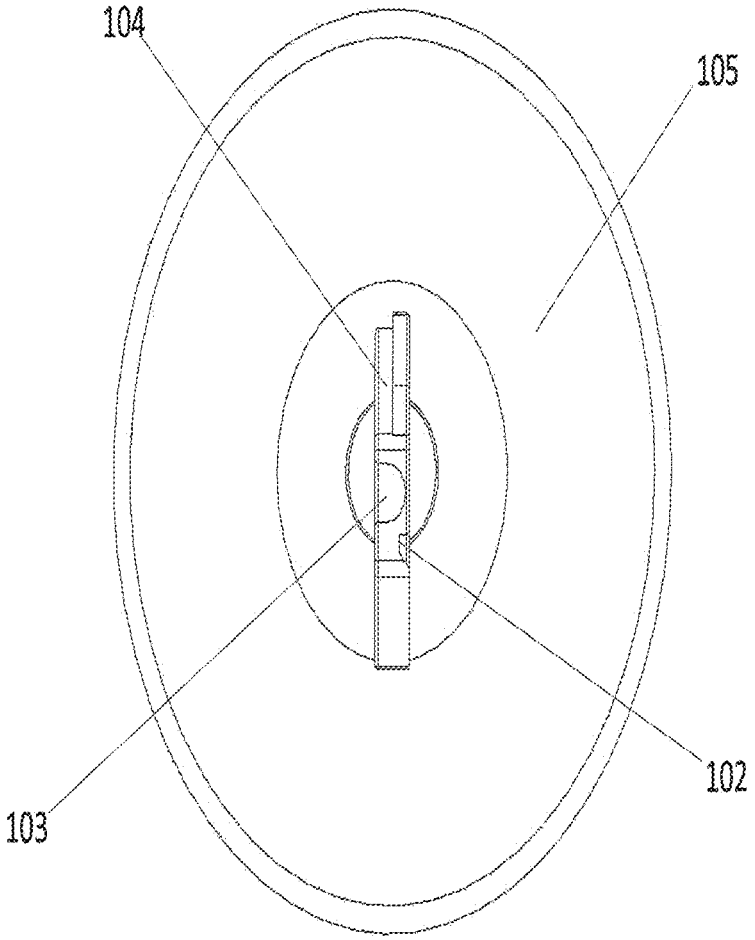
Figure 27:
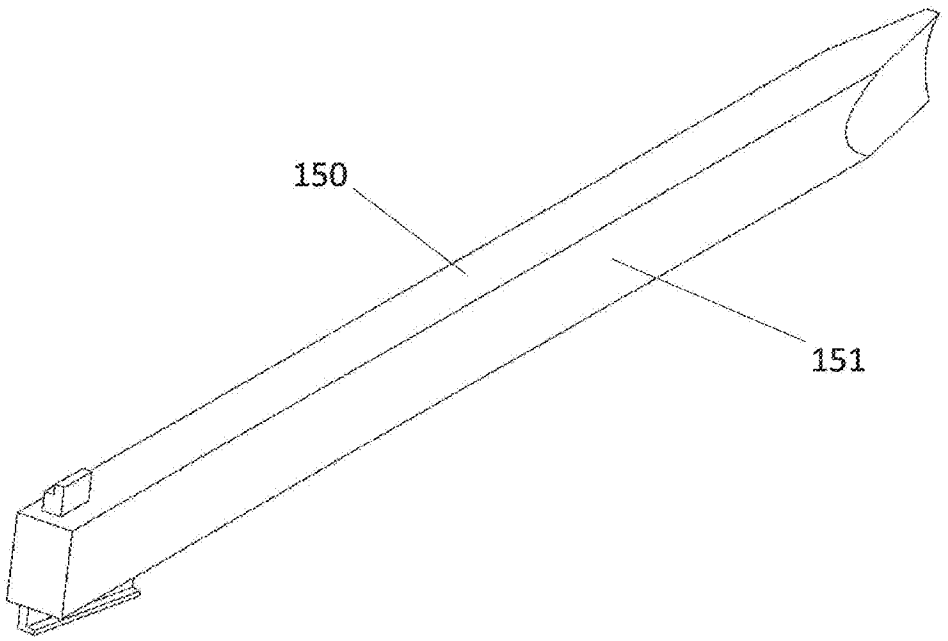
Figure 28:
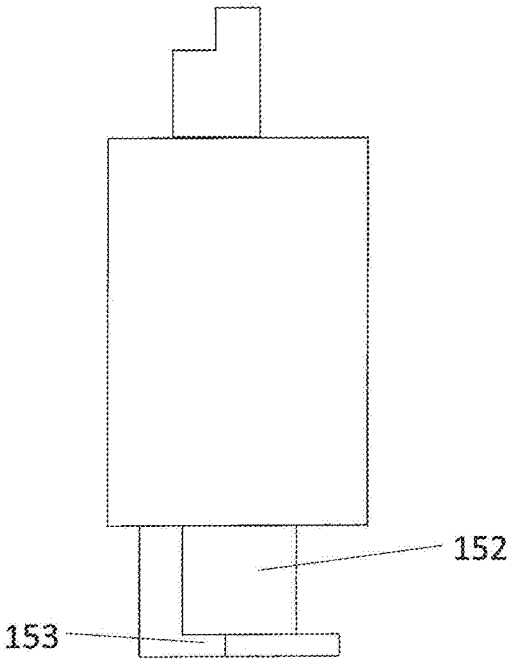
Figure 29:
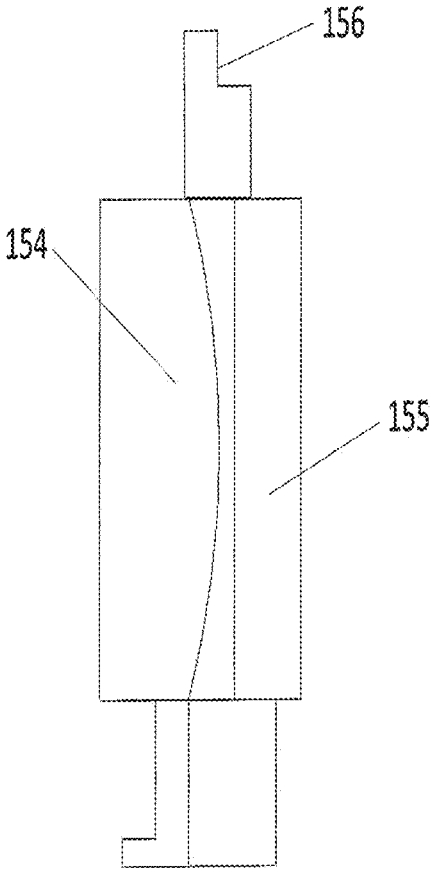

FIG. 25 depicts a magazine release button disassembly tool according to an embodiment of the present disclosure;

FIG. 26 depicts a front view of a magazine release button disassembly tool according to an embodiment of the present disclosure;

FIG. 27 depicts a magazine release button disassembly tool according to another embodiment of the present disclosure;

FIG. 28 depicts a front view of a magazine release button disassembly tool according to another embodiment of the present disclosure; and FIG. 29 depicts a rear view of a magazine release button disassembly tool according to an embodiment of the present disclosure.

DETAILED DESCRIPTION

Autonomous Trap Magazine

Embodiments of the present disclosure may improve upon current hopper designs, in that the hopper may be transformed into a magazine, and once assembled, it may remain assembled indefinitely. Furthermore, embodiments of the present disclosure may allow the magazine to be pre-loaded with clay targets at any time prior to a shooting session, and also may allow for the loaded magazine to be installed on or removed from the trap quickly without the need for hand tools. Multiple loaded magazines according to embodiments of the present disclosure can be utilized in succession to drastically reduce downtime between shooting sessions as compared to refilling a conventional hopper.

Figure 1:
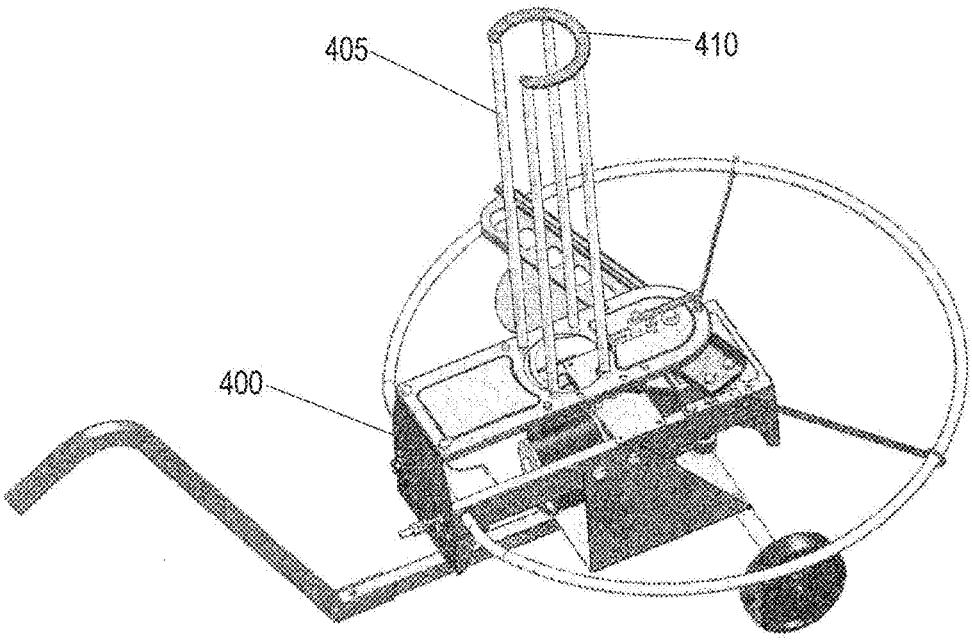
Fig. 1 Prior Art
FIG. 1 depicts a perspective view taken from the user's right side of a portable autonomous clay target trap as reflected in the prior art.
Figure 2A:
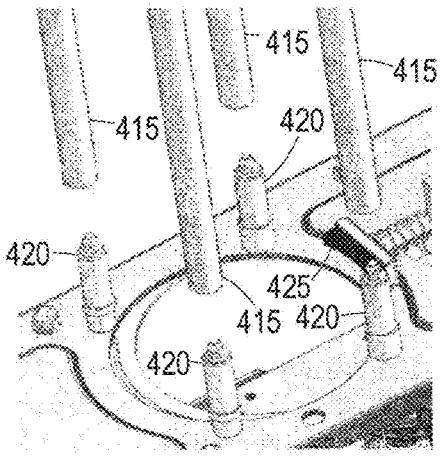
Fig. 2A Prior Art
FIG. 2A depicts a top down perspective view of the bottom of a hopper as reflected in the prior art.
Figure 2B:
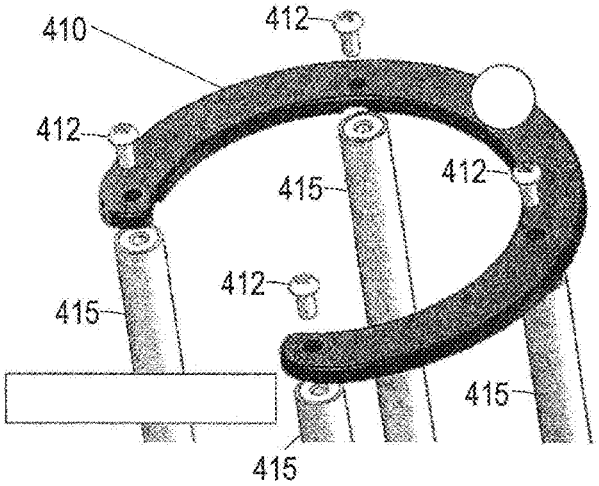
Fig. 2B Prior Art
FIG. 2B depicts a top down perspective view of the top of the plurality of guide tubes as reflected in the prior art.

FIG. 1 depicts a perspective view taken from the user's right side of portable autonomous clay target trap 400 according to the prior art. Trap 400 utilizes hopper 405 and top plate 410. FIG. 2A depicts a top down perspective detail view of the bottom of hopper 405 (FIG. 1), indicating a plurality of guide tubes 415 which insert individually over trap studs 420. The location of spring-loaded clay target holding block 425 is also shown. FIG. 2B depicts a top down perspective detail view of the top of the plurality of guide tubes 415 according to the prior art, to which top plate 410 is mounted using a plurality of screws 412.

Figure 3:
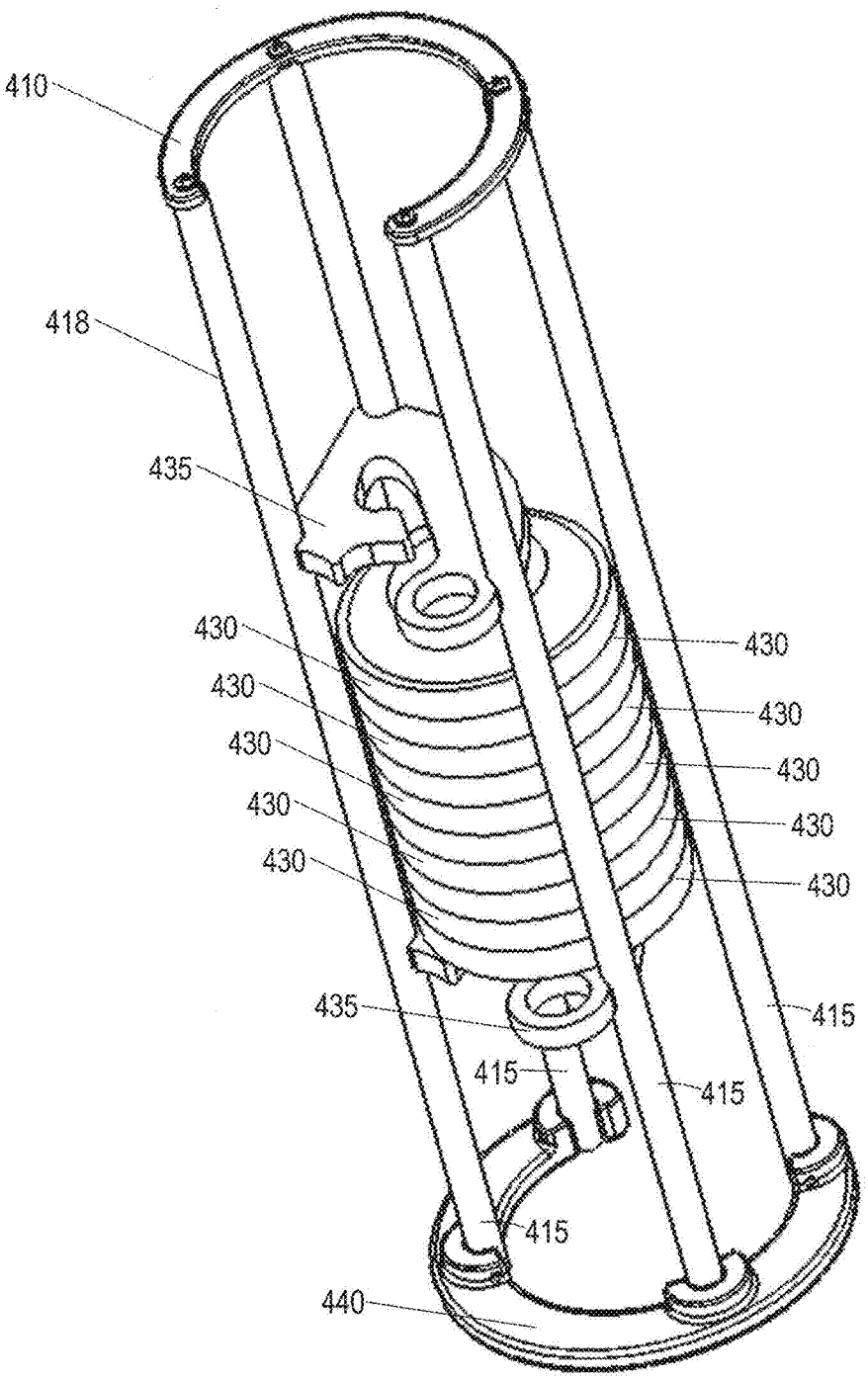
FIG. 3 depicts a top down perspective view of a magazine according to an embodiment of the present disclosure.

FIG. 3 depicts a top down perspective view of magazine 418 created from hopper 405. The plurality of guide tubes 415 may be inserted into permanently mounted bottom plate 440. However, there may be embodiments of the present disclosure wherein bottom plate 440 may not be permanently mounted. Further, while a plurality of guide tubes 415 are depicted, it should be appreciated that one or more guide tubes 415 may be utilized without departing from the present disclosure. Temporary stop-blocks 435 may be installed on either side of one or more individual clay targets 430.

Figure 4:
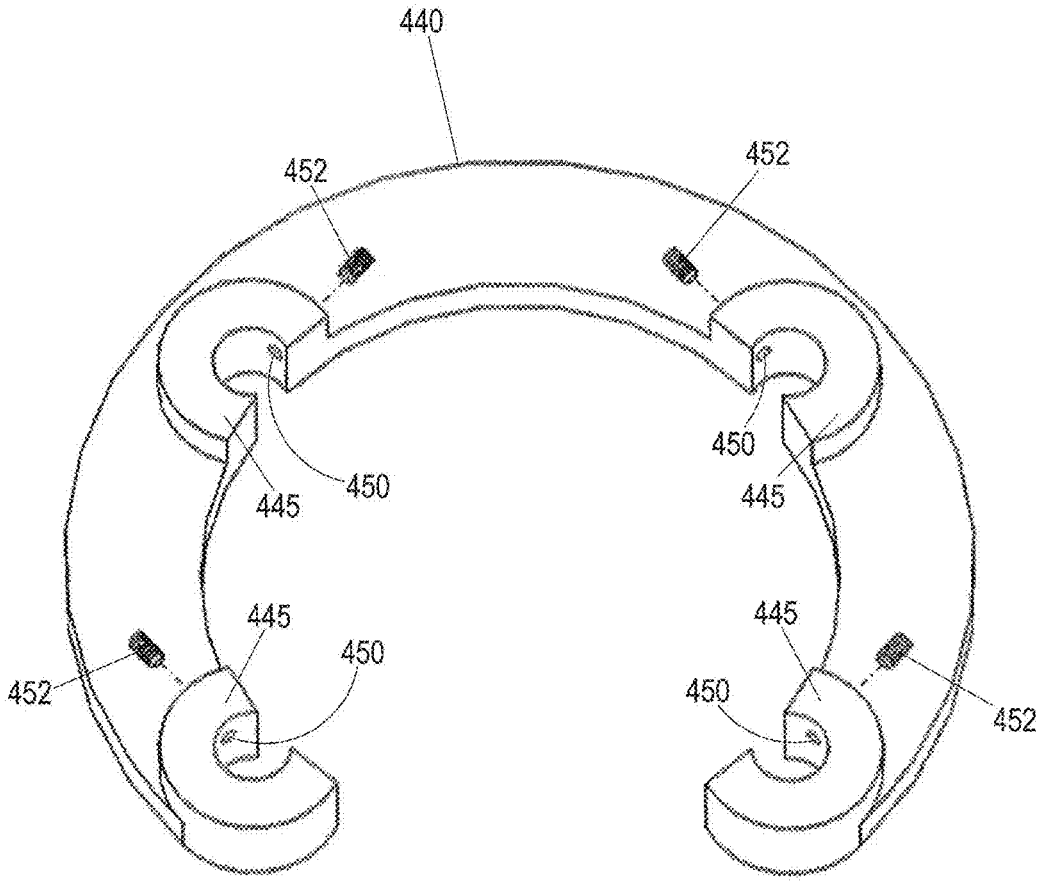
FIG. 4 depicts a top down perspective view of a bottom plate according to an embodiment of the present disclosure.

FIG. 4 depicts a top down perspective view of bottom plate 440 which may incorporate one or more integral raised supports 445. While supports 445 are described are integral, it should be appreciated that they may not be integral without departing from the present disclosure. Hole 450 may be placed into each support 445, which may accommodate set screw 452 that may tighten against one or more guide tubes 415 (FIG. 3).

Figure 5:
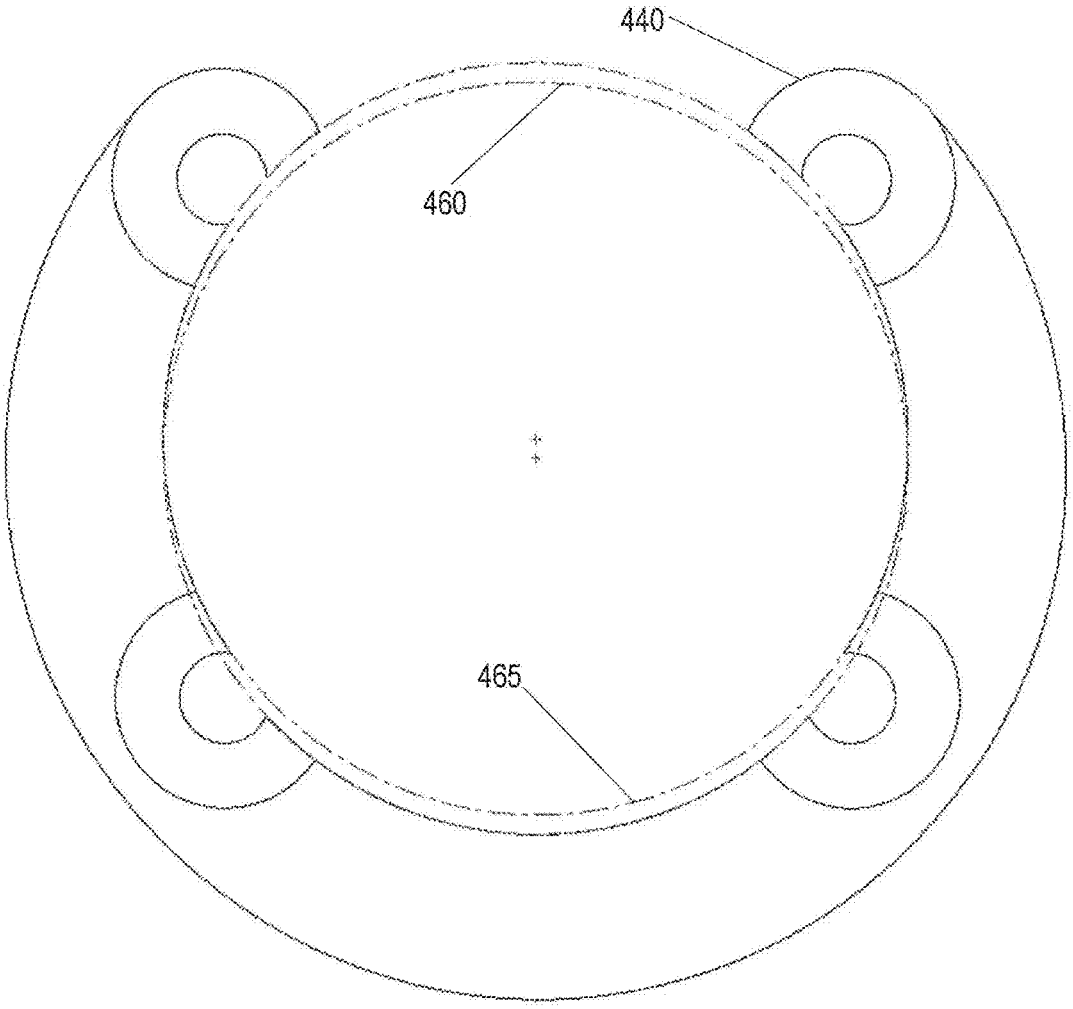
FIG. 5 depicts a top view of a bottom plate according to an embodiment of the present disclosure.
Figure 6:
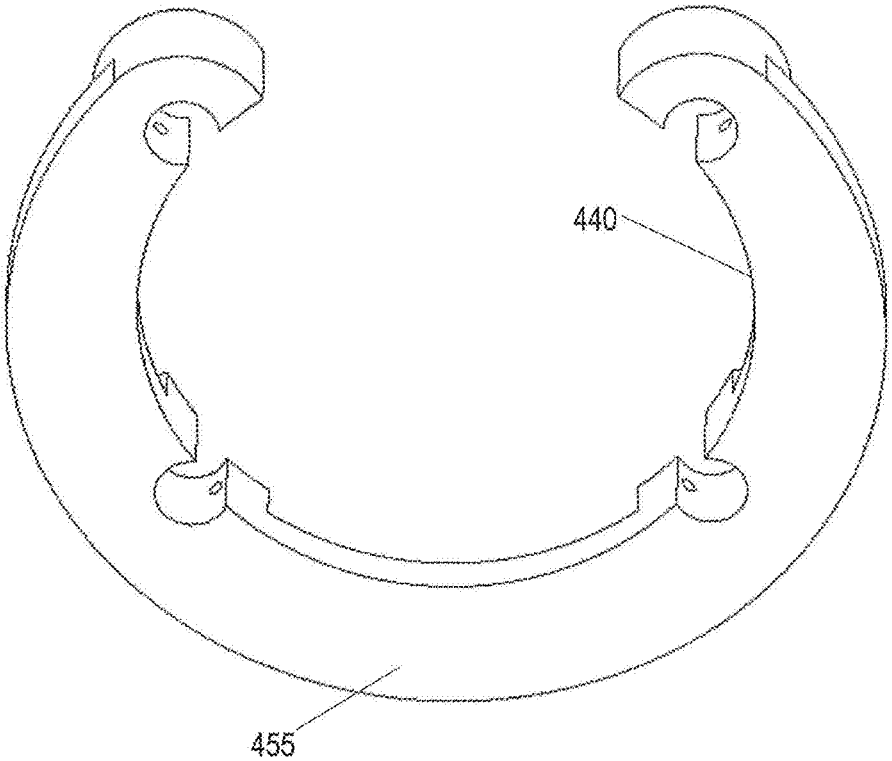
FIG. 6 depicts a bottom up perspective view of a bottom plate according to an embodiment of the present disclosure.

FIG. 5 depicts a top view of bottom plate 440 which may include rearward offset through-cut 460 and forward offset through-cut 465. FIG. 6 depicts a bottom up perspective view of bottom plate 440, which may incorporate flat bottom 455. However, it should be appreciated that there may be embodiments where bottom 455 is not flat without departing from the present disclosure.

Figure 7:
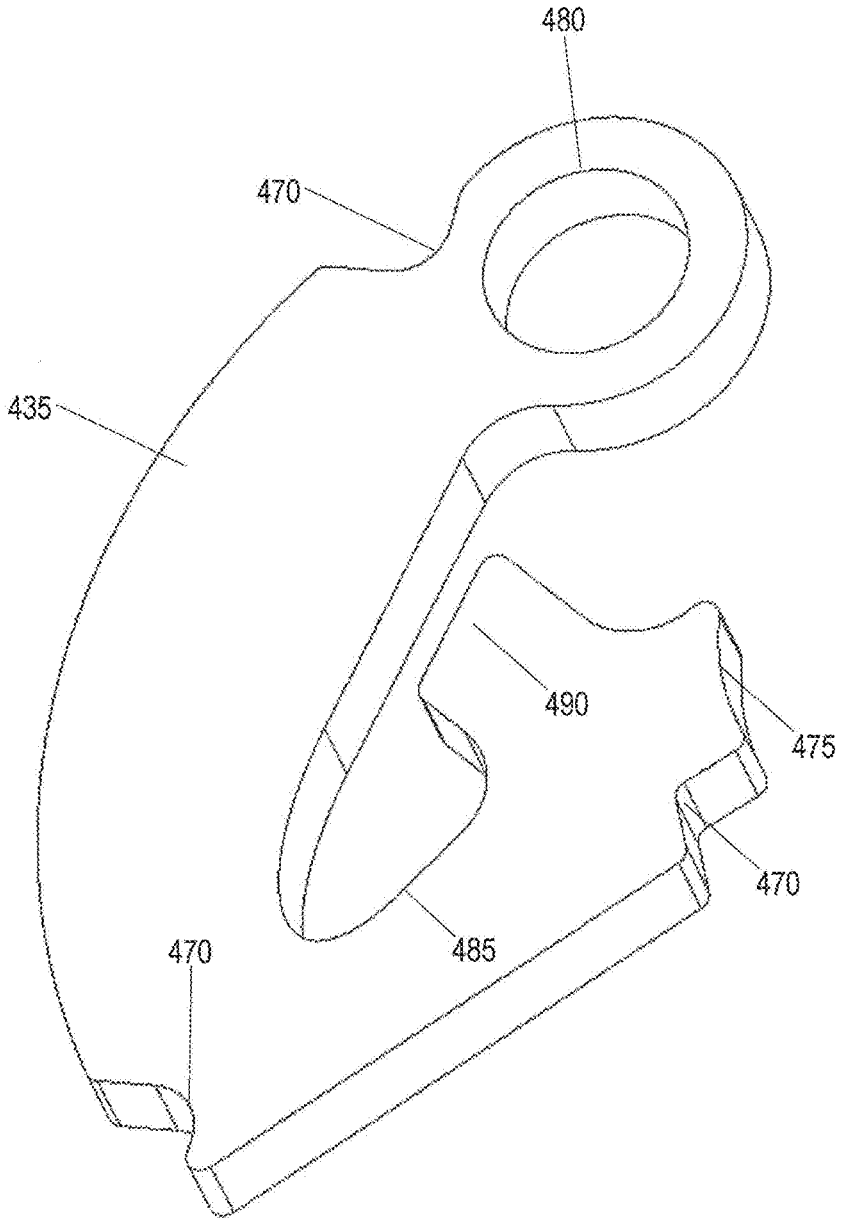
FIG. 7 depicts a top down perspective view of a temporary stop-block according to an embodiment of the present disclosure.
Figure 8:
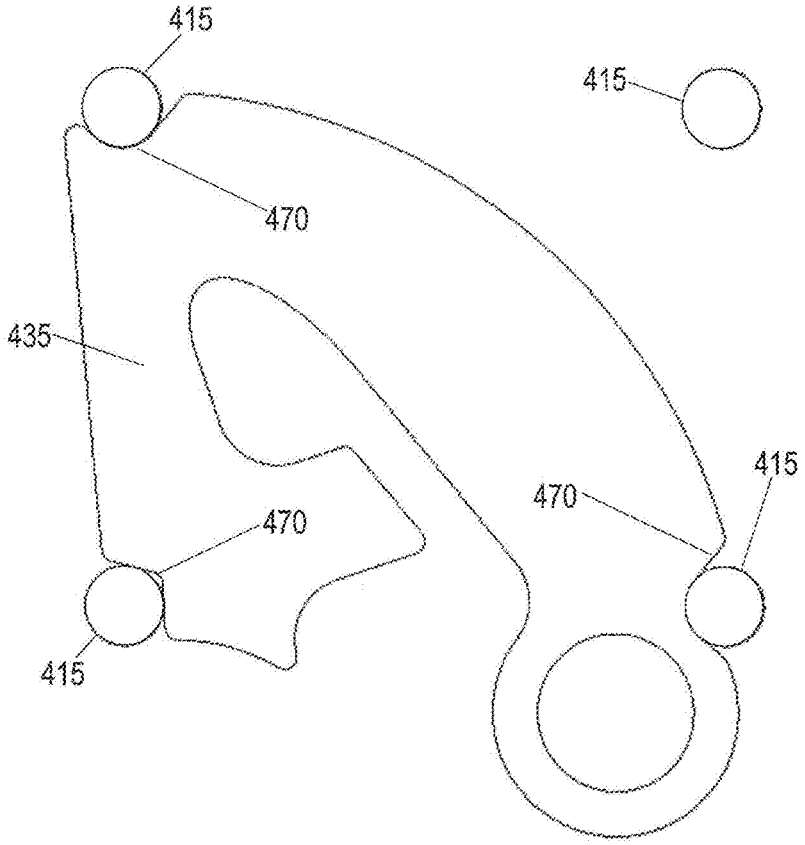
FIG. 8 depicts a top view showing the orientation of a temporary stop-block according to an embodiment of the present disclosure.

FIG. 7 depicts a top down perspective view of temporary stop-block 435 including one or more notches 470 which may press outwardly against one or more guide tubes 415 (FIG. 3) via tensioning slot 485. Travel stop 490 may limit movement of thumb button 475, while finger ring 480 may aid in the removal of stop-block 435 from one or more guide tubes 415 (FIG. 3). FIG. 8 depicts atop view showing an orientation of temporary stop-block 435 where one or more notches 470 may contact one or more guide tubes 415.

Operation according to embodiments of the present disclosure may be illustrated by evaluating the operation of hopper 405 (FIG. 1) from which magazine 418 may be derived. Typically a hopper may be inserted onto trap 400 by first individually installing one or more guide tubes 415 onto one or more trap studs 420. After one or more guide tubes 415 are installed on a trap, top plate 410 may be installed via screws 412 as shown in FIG. 2B, followed by inserting one or more clay targets 430 (FIG. 3) into an assembled hopper. In the past, this assembly process was required each time a trap is used. Embodiments of the present disclosure may convert the hopper into magazine 418 by the addition of bottom plate 440. In some embodiments, bottom plate 440 may be permanently attached which may allow top plate 410 to also be permanently attached. When magazine 418 has been assembled, it may then be fully loaded with one or more clay targets 430 which may be held in place by one or more stop-blocks 435 installed above and below the one or more clay targets. The magazine including one or more installed clay targets may then be placed on one or more trap studs 420 and the one or more stop-blocks can be removed.

Several design features of bottom plate 440 may aid in the utilization of the hopper as a removable magazine. For example, the horse-shoe open-ended shape of the bottom plate may allow for clay target holding block 425 to make contact with the edge of the lowest clay target and control the feeding of the clay targets into the trap. Further, bottom plate 440 may include aft cutout 460 (FIG. 5). This aft cutout may allow for clearance between the edge of the one or more clay targets and the bottom plate when the trap may be operated at various launch angles.

Weathercocking Arrowhead

Embodiments of the present disclosure may eliminate the destabilizing moment produced by a fixed-blade broadhead arrowhead by connecting a specially designed broadhead arrowhead to the arrow shaft through a multiple degree of freedom joint (pivot joint). The pivot joint allows the broadhead arrowhead to undergo pitching, yawing, and rolling motion decoupled from the motion of the arrow shaft. In combination with the introduction of the pivot joint, an arrowhead according to embodiments of the present disclosure may be designed such that the arrowhead itself may fly with positive stability while freely pivoting about the pivot joint. When designed according to these two conditions, the arrowhead may continuously align itself with the relative wind (i.e., weathercock), and therefore the arrowhead will not produce a destabilizing moment about the cg of the entire arrow. Thus, the restriction heretofore placed on the fixed-blade broadhead arrowhead can be removed; namely, the broadhead arrowhead blades according to embodiments of the present disclosure can be of relatively large span without affecting flight performance. Further, if the launcher (bow, crossbow, airbow, etc.) is tuned properly to minimize launch disturbances, conventional fletching usually required on the arrow to offset the destabilizing moment normally generated by the nosetip may be reduced significantly or eliminated entirely when a weathercocking arrowhead is employed.

FIG. 9A depicts a perspective view taken from the user's right side of weathercocking broadhead arrowhead 500 constructed in accordance with embodiments of the present disclosure. The arrowhead is attached to a standard arrow shaft 510 which may receive a conventional nock 515 located at the distal end of the shaft.

As shown in FIG. 9B the weathercocking arrowhead's body is pivotally connected by a connector element/socket 585 to the forward end of the arrow shaft 510. The aft end of socket 585 may be externally threaded to mate with internally threaded insert 590 that is rigidly connected to the arrow shaft. The arrowhead body and connector element are adapted to pivot through a multi-degree of freedom pivot joint (ball 560, socket 585, sleeve 570). The arrowhead body has a plurality of blades 540, and each of the blades extend aft of the pivot joint. The arrowhead body includes a central base/nosetip 530 connected to the connector element and one or more blades 540 connected to the nosetip. These broadhead blades can be permanently attached to the nosetip, or can be inserted into grooves in the nosetip and held in a fixed position such as through internally threaded blade-lock collar 580 which may mate with external threads (that may or may not be integral) located on the aft end of the nosetip. The arrowhead body includes ball 560, where said ball may be internally threaded to receive the externally threaded nosetip. The ball may be held in position against socket 585 by sleeve 570 whose forward end may be tapered to loosely contact said ball, and whose aft end may be left internally smooth and adhesively attached to the socket or whose aft end may be internally threaded for mechanical engagement with the socket. The arrowhead body may contact an immobilizer (alignment tube halves 520 and 525) which may be in sliding contact with the arrow shaft.

FIGS. 10A-10F depict a prior art broadhead arrowhead 550 (FIGS. 10A, C & E) and the weathercocking broadhead arrowhead 500 of the current invention (FIGS. 10B, D & F). The in-flight transverse aerodynamic forces acting upon an arrow equipped with a prior art broadhead arrowhead and with conventional fletching 555 are depicted in FIG. 10A. In flight, oscillatory pitching and yawing motion occurs about the cg 552 of the arrow and here the central axis of the arrow is depicted pitched to a non-zero angle of attack a with respect to the relative wind V at some instant in time. The transverse aerodynamic force F produced by the broadhead arrowhead 550 is multiplied by its distance xi forward of the cg and therefore produces a moment about the cg which is destabilizing for the arrow. To counteract the destabilizing moment produced by the broadhead arrowhead, the fletching is used to produce a stabilizing moment consisting of transverse aerodynamic force $F_2$ multiplied by distance $x_2$ aft of the cg. For stable accurate flight to occur with a prior-art broadhead arrowhead, the product $F_2x_2$ must always be greater than the product $F_1x_1$. In contrast, a weathercocking broadhead arrowhead 500 as depicted in FIG. 10B eliminates the existence of a transverse force forward of the cg 502 caused by the arrowhead, since the arrowhead enters free-flight having $\alpha$ equal to zero, and a substantially remains at zero throughout the flight due to the multi-degree of freedom joint with pivot joint rotational center 507. The arrow shaft 510 is forced to pivot about the multi-degree of freedom joint linking the shaft to the arrowhead, and the moment $F_3x_3$ stabilizes the arrow shaft without the need for fletching. Even though not required, fletching may still be utilized in conjunction with the current invention without ill-effect.

FIG. 10C depicts a front view of a prior art broadhead arrowhead and shows the relative circumferential positioning of one or more blades 551 about nosetip 1530 and the circumferential positioning of the fletching 555. The location of the section view (FIG. 10E) which may pass through the center of said nosetip is also indicated. FIG. 10D shows the relative circumferential positioning of one or more blades 540 about nosetip 530 and the axisymmetric geometry of the alignment tube composed of symmetric halves 520 and 525. The location of the section view (FIG. 10F) is also indicated which may pass through the center of said nosetip.

Multiple examples of prior art broadhead arrowheads can be found in open literature. FIG. 10E depicts a left side cutaway view of a common embodiment of a prior art broadhead arrowhead, showing an aft externally threaded end of nosetip 1530 to which internally threaded blade-lock collar 1580 may be mechanically attached. Broadhead blades 551 can be permanently attached to the nosetip or can be inserted into grooves in the nosetip and held in a fixed position via the threaded blade-lock collar. The aft end of nosetip 1530 may be externally threaded to mate with internally threaded insert 1590, which may be rigidly attached to the arrow shaft 1510.

FIG. 10F depicts a left side cutaway view of a weathercocking broadhead arrowhead in a state just prior to launch.

Some prior art components shown in FIG. 10E, such as arrow shaft 1510, nosetip 1530, blade-lock collar 1580, and internally threaded insert 1590, may be similar to or the same as arrow shaft 510, nosetip 530, blade-lock collar 580, and threaded insert 590 of an embodiment of the present invention shown in FIG. 10F, which may allow reuse of these prior art components with the present invention. Similarly, prior art nock 1515 of FIG. 10A may be similar or the same as nock 515 of FIG. 10B of the present invention.

During launch, the immobilizer is initially required to align the arrowhead body with the arrow shaft. As shown in FIG. 10G, in the preferred embodiment an alignment tube defines a first surface 532 adapted to contact the shaft and a second surface 535 contacting a portion of the arrowhead body in the pre-launch condition. The alignment tube is removably attached to the arrowhead body and defines a central tubular aperture closely receiving the shaft and the arrowhead body. The alignment tube may have a planar surface 538 oriented perpendicularly to an axis defined by the shaft prior to launch. The alignment tube is adapted to allow passage of the arrow and may fall away from the arrowhead body when an arrow including the arrowhead body is launched. The planar surface 538 may catch the relative wind and may also help move the tube rearward with respect to the broadhead arrowhead and away from the arrow shaft during launch, which then frees the weathercocking arrowhead to align itself with the relative wind. After the arrow has been launched, the alignment tube is left behind at or near the launcher.

As shown in FIG. 10H the weathercocking arrowhead is adapted to pivot through the multi-degree of freedom pivot joint. Each of the blades 540 has a forward edge 565 connected to the central base and an aft edge 568 spaced apart from the aft portions of the other blades to define an aft space 548 aft of the central base. The connector element is received in the aft space. The aft portions of the blades are laterally spaced apart from the connector element. The aft space provides ample clearance for unhindered relative motion between the arrowhead and the arrow shaft to occur while in flight.

Again referring to FIG. 10H, to properly weathercock, the broadhead arrowhead 500 must itself have a net-sum moment about the pivot joint that is stabilizing. If the arrowhead obtains a non-zero angle of attack a with the relative wind V, such a stabilizing moment will quickly force the arrowhead central axis back into alignment with the relative wind and therefore ensure that the arrowhead will always weathercock. To ensure the moment about the pivot joint is stabilizing, as opposed to destabilizing, the neutral point 505 of the arrowhead must be aft of the pivot joint rotational center 507 which also coincides with the geometric center of ball 560. The neutral point is classically defined (see for example: *Introduction to Aeronautics: A Design Perspective*, Brandt, S. et al, Ch. 6: Stability and Control p. 206) as that location on an aerodynamic body in flight where the aerodynamic body is neither stable nor unstable; if forced to pivot about this location the arrowhead body would remain fixed in attitude at a prescribed angle of attack until perturbed. Conversely, if the neutral point is located in front of the pivot joint rotational center the arrowhead body would immediately pivot to its mechanical limit after launch and cause the arrow to sharply diverge from its intended flight path. The neutral point location is a function of the blade planform shape (see for example: Calculating the Center of Pressure for a Model Rocket, Barrowman, J., p. 18). Since the neutral point must lay aft of the pivot joint rotational center for weathercocking of the arrowhead to occur, it is a design requirement for the weathercocking arrowhead that blades 540 extend aft of the pivot joint.

Induced rolling of an arrow about its central axis is common practice in prior art arrows and is achieved by canting the fletching with respect to the relative wind. The purpose of rolling the arrow is to increase accuracy (see for example: Modern Exterior Ballistics, McCoy, R., p. 237) by roll-averaging the effects of any asymmetric aerodynamic forces caused, for example, by: oscillatory flexing of the arrow shaft during launch, a geometry asymmetry such as a damaged blade, or a manufactured asymmetry such as lateral offset of the cg 552 (FIG. 9B). Similarly, for the reason of increased accuracy the preferred embodiment of the weathercocking arrowhead allows for rolling motion to be superimposed on the pitching and yawing motion of the arrowhead about the pivot joint. FIGS. 10I-10P address various techniques for inducing rolling of the broadhead arrowhead about the pivot joint in order to increase accuracy of the arrow. These roll-producing techniques applied to each of the blades of the arrowhead body incorporate designed asymmetry (blade 540 with cant angle δ 547, blade 541 with leading edge bevel 544, blade 542 with bent trailing edge 545, blade 543 with airfoiled surface 546) that may be employed separately or in combination with one another to produce the desired roll rate of the arrowhead. FIG. 10I shows blades 540 at a cant angle δ 547 to the central axis of nosetip 531. FIG. 10J shows the relative circumferential positioning of one or more canted blades 540 about nosetip 531. FIGS. 10K-10P show other embodiments of the weathercocking arrowhead that may produce a rolling moment. These embodiments produce roll via geometry modification to the blades themselves. FIG. 10K shows blade 541, whose leading edge 544 is beveled on one side only as shown in FIG. 10L to produce a rolling moment about the symmetry axis of the broadhead arrowhead. FIG. 10M shows blade 542, whose trailing edge 545 is bent to one side as shown in FIG. 10N to produce a rolling moment about the symmetry axis of the broadhead arrowhead. FIG. 10O shows blade 543, whose surface 546 is airfoiled as shown in FIG. 10P to produce a rolling moment about the symmetry axis of the broadhead arrowhead.

Weathercocking broadhead arrowhead 500 may be designed such that nosetip 530, blades 540, and ball 560 may form a broadhead arrowhead whose neutral point 505 lies aft of the geometric center of ball 560. The ball may be loosely captured in position against socket 585 which may mate with the ball to form a ball-and-socket joint. This joint may allow the broadhead arrowhead to pivot freely with respect to arrow shaft 510 and weathercock into the relative wind during flight. The initial position of the broadhead arrowhead relative to arrow shaft 510 may be held fixed and in axial alignment by means of alignment tube halves 520 and 525. As the arrow is launched and begins to accelerate, the relative wind may push against the alignment tube halves, causing the broadhead blades to decouple from the tube and self-align with the oncoming air flow. Relative motion between the arrow and the alignment tube may allow the alignment tube to cleanly separate from the arrow. Once disengaged from the alignment tube, the stabilizing moment produced by the broadhead arrowhead about the pivot joint may cause the broadhead arrowhead to remain aligned with the relative wind throughout the flight of the arrow, thus reducing or eliminating the need for fletching. To enhance accuracy, rolling motion superimposed on the yawing and pitching motion of the broadhead arrowhead may be induced through designed asymmetry of the blade elements. Embodiments of the present disclosure may utilize commercially available arrow shafts, nocks, and shaft inserts, and nosetips. Conventional metals and plastics can be utilized for each component, and machining practices such as lathe work, milling, and injection molding can be incorporated in manufacturing a weathercocking arrowhead according to embodiments of the present disclosure.

Smoothbore Shotgun Slug

Embodiments of the present disclosure may improve on both the accuracy and lethality of conventional smoothbore shotgun slug designs while retaining the inherent flexibility and lower cost advantages inherent in the smoothbore shotgun. Embodiments of the present disclosure may include a forward-located obturating gas seal surrounding the slug body, which may eliminate the requirement for a sealing wad between the propellant and the slug and may allow the portion of the slug body aft of the obturator to extend into the propellant bed. Propellant gases may act upon the entire slug body aft of the obturating seal to both propel the slug down the bore and to counteract set back forces generated on the slug body due to the inertia of the interior payload. The forward located obturator seal also may allow for increased length of the slug, which in turn may allow for increased static margin of the slug via forward shifting of the center of gravity, and rearward shifting of the center of pressure. Multiple fins at the rear of the slug body may aid in shifting the center of pressure aft while allowing room within the propellant bed for both ignition between the primer and the propellant, and subsequent flame propagation throughout the propellant bed. The increased length of the slug body also may allow for a multitude of payload configurations to be incorporated within the aerodynamic body outline, which may allow tailoring of the slug to meet specific practice, hunting, self-protection, military, or law-enforcement objectives.

FIG. 11 depicts a front perspective view taken from the user's right side of slug 300 that may be launched from a smoothbore shotgun barrel constructed in accordance with embodiments of the present disclosure. The body of slug 300 may be composed of nose cap 305 attached to forward bulkhead section 312 which may support pliable obturator ring 310. Aft body 315 of slug 300 may be integrally connected to finset 320; however, there may be embodiments of the present disclosure where aft body and finset may not be integrally connected. Finset 320 may be composed of at least three fins, and each fin may have a rounded leading edge 326, a compression bevel 324, and an expansion face 322, and each fin may be canted with respected to the axis of symmetry of slug 300. The body of slug 300 may be made from plastic such as styrene, urethane, or polyester, for example, using standard plastic molding or 3D printing technology. The body of slug 300 may be manufactured as an assembly of parts wherein nose cap 305 may be separately produced from integrally produced forward bulkhead 312, aft body 315, and finset 320, or in some embodiments of the present disclosure, longitudinal sections or the entire body of the slug can be produced as an integral unit.

FIG. 12 depicts a side view of slug body 300 (FIG. 11) shown as a component in a side section view of cylindrical shotgun shell 330 in an assembled state. Circumferentially attached pliable obturator ring 310 may be tightly compressed against the inner sidewall of shell 330 which may seal against propellant gas pressure generated in propellant compartment 332. Flame propagation from primer 336 to propellant compartment 332 may be enabled via flame channel opening 333 in the base of finset 320. Obturator ring 310, aft body 315, and finset 320 may be in contact with the propellant in propellant compartment 332 and may be acted upon by the pressure generated by the burning propellant. Frangible card wad seal 334 positioned over nose cap 305 may be stabilized by granular plastic buffer material stored within buffer compartment 335 and held in position by roll crimp 338 at the forward end of the shell.

FIG. 13 depicts a side section view of slug body 300 showing one embodiment of the present disclosure containing attached nose cap 310 and high-density metal sphere 340 in a forward cavity separated by integral interior bulkhead 347 from an aft cavity containing one or more pellets 345 that may be formed of metal.

FIG. 14 depicts a side section view of slug body 300 showing another embodiment of the present disclosure having a fully integral body and containing high-density combined cylindrical-conical body 342 in a forward cavity separated by integral interior bulkhead 347 from an aft cavity containing one or more pellets 345 that may be formed of metal.

FIG. 15 depicts a side section view of slug body 300 showing another embodiment of the present disclosure having a fully integral body and containing high-density combined spherical-cylindrical-conical body in a single forward cavity.

FIG. 16 depicts a front perspective view of slug body 301 showing another embodiment of the present disclosure where obturator ring 310 (FIG. 1) (which may be pliable) has been replaced with a pliable, fully split obturator seal composed of right half 350*a* and left half 350*b*. Interface 351, which may split the obturator seal into two identical halves, may be rotationally symmetric about the axis of symmetry of slug body 301.

FIG. 17 depicts a side section view of slug body 301 showing right half 350*a* and left half 350*b* of the fully split obturator seal with ramped interface 352 between the obturator seal and slug body 301. Interface 352 may include vertical gap 353 between the obturator seal and slug body 301. The obturator seal may be comprised of rearward facing cutout 355 and forward facing chamfer 357 and outer wall 360 which may interface with the inner wall of shell 330 (FIG. 2). Slug body 301 may contain one or more high density metal pellets 346 in a forward cavity with forward opening 358, separated by interior bulkhead 347, which may or may not be integral, from an aft cavity containing one or more smaller metal pellets 345.

Slug 300 (FIG. 1), which may be used in a smoothbore shotgun, may be conventionally loaded into primed shotgun shell 330 (FIG. 2) by placing a quantity of propellant into the base of the shell. Obturator ring 310 may be placed onto the body of the slug and positioned just aft of forward bulkhead 312. Slug 300 may then be inserted into the shell until finset 320 may rest on the interior base of the shotgun shell. A granular plastic buffer may then be placed on top of nose cap 305 to fill the volume between the slug body and the shotgun shell ahead of the forward bulkhead; however, the buffer may be comprised of other materials without departing from the present disclosure. A card wad may then be placed on top of the buffer and the shotgun shell may then be crimped. Firing of the loaded shotgun shell may then be conducted as known to one of ordinary skill in the art. When slug 300 reaches free-flight, it may begin to roll about its longitudinal axis, which may decrease dispersion due to roll-averaging asymmetric forces acting upon the slug. At impact, for a slug equipped with dual penetrator mechanisms, such as shown in FIG. 4, forward penetrator 342 may decrease in velocity allowing rear pellets 345 to overtake the forward penetrator and disperse radially within the wound cavity.

Manufacturing of slug body 300 (FIG. 1) and its variations (FIG. 3, FIG. 4, and FIG. 5) and slug body 301 (FIG. 6) can be accomplished via fused filament fabrication (FFF) in embodiments of the present disclosure. The lethal sub-munition components (340, 342, 344, 345, and 346) can be inserted during the FFF manufacturing process, and the slug body may be completed with an integral nose cap, or the slug can be fabricated with separate nose cap 310 and assembly of the lethal sub-munition components can be accomplished after the slug body fabrication is completed. Other methods of fabrication, which may include but are not limited to selective laser sintering, stereo lithography, or conventional injection molding processes, can also be utilized to manufacture the slug body in embodiments of the present disclosure.

Quick-Detachable Multi-Purpose Accessory Mounting Platform

Accessories including but not limited to flashlights and spotlights may be mounted in parallel with the barrel of the firearm and can be brought into action while the firearm is in the mounted position. Such accessories may be helpful for identifying and selecting game in the field under low-light or no-light conditions. Utilization of these illuminating devices may be known to one of ordinary skill in the art. However, reasons for mounting a remote transmitter on the firearm within easy reach of the operator may be more complex. It is common practice for a hunter, when using a remote transmitter for dog behavior correction, to carry the transmitter either in a holster attached to a belt around the waist, on a lanyard around the hunter's neck or wrist, in a shoulder sling, or even in his/her pants-pocket. None of these conventional carry positions for a transmitter are conducive to applying a corrective stimulus to the dog when the hunter is in the act of aiming and firing the firearm. The situation can become particularly dangerous to a hunting party if correction to unruly dog behavior is ill-timed when applied, or is not able to be applied at all. These issues can occur due to the transmitter not being within easy reach of the hunter.

A typical scenario may involve hunting with a young or unfamiliar dog on-leash that has not been completely trained to stay in the "heel" or "sit" position as the gun is mounted and fired. Many times, an unsteady dog will break enthusiastically in this situation, and may therefore unexpectedly jerk the hunter to the point of falling, which can cause the firearm to accidentally discharge with potentially disastrous consequences. In this case, the timing of the correction should be applied when the dog is in the act of breaking. If the dog reaches a point of several feet away from the hunter before being corrected, then the dog typically does not correlate the applied corrective stimulus to the act of breaking. Furthermore, if the dog continues to repeatedly break at the sight and sound of gunfire without being properly corrected, an unintentional breaking behavior is learned that becomes extremely difficult to correct as the dog matures and the habit fully forms. Therefore, this dangerous behavior may continue to reappear unexpectedly throughout the lifetime of the dog.

Another scenario where timing of the correcting stimulus being applied may be critical can occur when a dog nears unexpected danger in the field, such as when encountering a poisonous snake. A dog without proper training may be overly curious and approach within striking distance of the snake. In this situation, a properly timed correction given by the hunter can save the dog's life. The preceding examples are only some of many possible scenarios where a corrective stimulus applied at the proper time to the dog via a remote transmitter can prevent an emergency situation from occurring. In all cases, having the transmitter easily available and close at hand may aid in correctly timing the application of the corrective stimulus.

FIG. 18A depicts a perspective view taken from the user's right side of a multi-purpose accessory mounting platform 200 according to an embodiment of the present disclosure. The forward end of the platform may incorporate one or more thumb screws 205 and one or more threaded inserts 210, which may mate together to secure the platform to the firearm (not shown) via both split barrel clamp 235 and split ventilated rib clamp 240. Integral hinge 215 (FIG. 18A, 19, 21A) may extend between the clamp faces in an embodiment of the present disclosure. At least one recessed circumferentially arranged mounting pad 220 (FIG. 18A, 18B, 20A, 21A) may be incorporated into the platform which may provide locations for accessories to be attached to the platform via hook and loop type adhesive backed fabric fasteners (not shown). Fasteners may include but are not limited to Velcro, Dual-Lock, Picatinny rail sections or similar fastening mechanisms. Surfaces 250 (FIGS. 18A, 18B) may be located along the forward sides of the platform for additional accessory mounting points according to embodiments of the present disclosure. Rear shelf 225 (FIGS. 18A, 19), which may be integrally attached to the rear of the platform, may incorporate one than one shelf flat 230 (FIGS. 18A, 19) that may be oriented parallel to the faces of the mounting pads. The platform may be made from plastic such as styrene, urethane, or polyester and manufactured with techniques including but not limited to plastic molding or 3D printing technology.

FIG. 18B depicts a left perspective view of the platform, showing left-side mounting pad 220 and left-side surface 250. Circular mounting holes 285 may be provided as receptacles for threaded inserts 210 (FIG. 18A). The inserts can be pressed into place and held by friction or permanently attached using adhesive in embodiments of the present disclosure.

FIG. 19 depicts a front view of the platform, showing at least one shelf flat 230 incorporated into rear shelf 225, split barrel clamp 235, split ventilated rib clamp 240 and monolithic hinge 215. Bearing surfaces 245 (FIGS. 19, 21B) that may be attached to the clamp halves below the axes of the thumb screws are also shown.

FIG. 20A depicts a right-side view of the platform, showing right side accessory mounting pad 220 and right side mounting surface 250, and showing elongated holes 255 through which thumb screws 205 (FIG. 18A) may pass. The axis of elongation may be oriented perpendicular to the contact line between bearing surfaces 245 (FIG. 19). Also shown in FIG. 20A are section lines 3B and 3C corresponding to FIG. 20B and FIG. 20C.

FIG. 20B depicts a cutaway perspective view showing the orientation of mounting slots 260 (FIGS. 20B, 20C). The slots may provide passageways through which strips of non-adhesive backed hook and loop fasteners can be threaded and then fastened around a mounted accessory to supplement or replace the adhesive backed fasteners that may have been attached to the mounting pads. The slots generally may run in between the inner and outer wall of the platform parallel to the outer flat surface of the corresponding mounting pads and may not penetrate inner surface 265 (FIGS. 20B, 21B) of the platform.

FIG. 20C depicts a cutaway perspective view showing the location and geometry of one or more central mounting slots 270 that may be located at the forward end of each mounting pad. These slots may not penetrate through interior surface 265 (FIG. 20B) but instead may open into corresponding mounting slots 260. The one or more central mounting slots may provide a passageway for a hook and loop strip fastener running through the central mounting slot(s) and exiting through only one side of corresponding mounting slot 260; the loop of the closed strip fastener may be offset either left or right of the longitudinal center of the mounting pad to accommodate accessories including but not limited to a remote transmitter having a non-centered antenna.

FIG. 21A depicts a bottom view showing the orientation of third mounting pad 220 that may be centrally located and oriented orthogonally to the sides of the platform. Also shown is the orientation and relative length of hinge 215 that may connect the two halves of a barrel clamp in embodiments of the present disclosure.

FIG. 21B depicts a top view of the mounting platform showing smooth interior surface 265. Also shown is the orientation and relative length of bearing surfaces 245. Portal 280 through the platform may allow access to the fore-end of the firearm to enable a carrying sling (not shown) to connect to the firearm in embodiments of the present disclosure.

FIG. 22 depicts a left side perspective view showing an alternate embodiment of multi-purpose accessory mounting platform 300. Attachment of the platform to the firearm may be accomplished by at least one friction clamp 305. Accessories may be mounted to the platform via adhesive-backed hook and loop type fasteners or Picatinny rail sections attached to flat mounting surface 310. Similar mounting surfaces may be arranged on the bottom and the right side of the platform in some embodiments of the present disclosure.

FIG. 23 depicts a left side perspective view showing another embodiment of a multi-purpose accessory mounting platform 340. Accessory mounting may be accomplished via adhesive-backed hook and loop type fasteners or Picatinny rail sections attached to recessed mounting pad 342 in an embodiment of the present disclosure. Similar recessed mounting pads (not shown) may be arranged on the bottom and right side of the platform without departing from the present disclosure. At least one upper tie down post 345 and lower tie down post 350 may provide a means for supplemental restraint of the accessory via elastic bands or cords laced around the posts. Flush hinge 360 may connect the two halves of the barrel clamp and provide an additional mounting surface for accessories in embodiments of the present disclosure.

FIG. 24 depicts a left side perspective view showing yet another embodiment of a multi-purpose accessory mounting platform 380. Accessory mounting may be accomplished via adhesive-backed hook and loop type fasteners or Picatinny rail sections attached to recessed mounting pad 382. Similar recessed mounting pads (not shown) may be arranged on the bottom and right side of the platform without departing from the present disclosure. At least one upper tie down hole 385 and lower tie down post 350 (FIG. 23) may provide a means for supplemental restraint of the accessory via elastic cords or non-stretch cords. Tie down may be accomplished by lacing a cord (i.e., one cord per mounting pad) through the one or more holes and looping the cord around the one or more posts. An interior embedded channel including recess 390 may be attached to embedded cable slot 397 and terminated by second recess 395 in an embodiment of the present disclosure. The embedded channel may contain the cord ends and loops interior to the platform. The one or more holes and posts, and the channel may be symmetrically arranged on opposing sides of the platform without departing from the present disclosure.

Platform assembly 200 may be installed on a single barrel firearm by first detaching the fore-end mounted sling, if present, and then inserting the firearm's muzzle from the rear of the platform forward through barrel clamp halves 235. The rear section of the platform may partially extend over but not contact the fore-end of the firearm, thus allowing free motion of a sliding fore-end such as when the device may be employed on a pump-action firearm. The sling may then be reattached to the fore-end through portal 280 (FIG. 21B). Once in position, one or more thumb screws 205 may be tightened, causing the barrel clamp halves and ventilated rib clamp halves 240 to apply pressure to the firearm. If a ventilated rib is present on the firearm, the ventilated rib clamp halves may contact that portion of the firearm, followed by line contact between the halves of bearing surfaces 245 (FIG. 19), and then by contact between the barrel clamp halves and the barrel. Elongated holes 255 (FIG. 20A) through the mounting platform may provide clearance and ensure that the one or more thumb screws do not bind as the clamp halves may be drawn together. Once mounted, the platform may provide multiple secure attachment pads 220, and mounting surfaces 250 for accessories which may be temporarily secured to the mounting platform with hook and loop style fasteners attached to both the accessory and the mounting pads or flats. Alternatively or additionally, hook and loop style straps can be inserted into slots 260 and 270, and the straps may be adjusted for best fit by sliding along the slots. Shelf 225 may provide a pivot point for initial alignment of the accessory during the mounting process, and also may serve as a base for supporting the accessory while it is mounted on the platform. When hook and loop fasteners may be employed on the mounting pads, the body of the mounted accessory may be raised from the surface due to the thickness of the fastener. In this case, the accessory can be positioned over the shelf closer to the hunter; while in this position, the accessory may rest on the shelf flat and can utilize the shelf flat for increased stability.

Accessories which may be mounted on mounting pads 220 may be located close to the hunter's hand holding the fore-end of the firearm. The index finger or thumb of the hunter's hand can be extended to operate the accessories with little effort, and without disrupting the mounting or operation of the gun during the act of firing. Additionally, when the hunter is seated and holding the firearm such that it is located between the hunter's legs and oriented with its butt end on the ground and the muzzle pointing up (such as may be the case when game is approaching), the mounted accessories, such as a remote transmitter, may easily be reached and operated by either hand.

While embodiments of the present disclosure may utilize thumb screws, it should be appreciated that other fastening mechanisms may be utilized without departing from the present disclosure. FIG. 30 depicts a front view of a platform according to an embodiment of the present disclosure incorporating four disc-shaped magnets 391 in place of thumb screws, and FIG. 31 depicts a side view of a platform according to an embodiment of the present disclosure showing the four disc-shaped magnets 391 in position. Further, while the mating surface around the barrel is depicted in some embodiments of the present disclosure as being round, it should be appreciated that the mating surface may assume other shapes without departing from the present disclosure. FIG. 30 depicts a hexagonal-shaped mating surface 392 according to an embodiment of the present disclosure.

Glock Magazine Release Button Removal Tool

Embodiments of the present disclosure may provide a tool which may be used on a Glock pistol to manipulate the free end of the magazine release button spring into and out of a slot in the magazine release button and therefore allow for the removal and installation of the magazine release button without damaging the interior of the magazine well. Tool 100 depicted in FIG. 25 may include several features which may aid in the removal and installation process. Wide blade 101 may move the spring to the side of the slot in the magazine release button. Hook 102 (FIG. 26), which may or may not be integral, at the end of the blade may be positioned under the spring to withdraw the free end of the spring through the opening in the slot and away from the button. Cavity 103 may be located on the face of the blade and may guide the released end of the spring away from the magazine release button in a direction opposite the line of fire and may allow the button to be transversely withdrawn from the frame and either replaced or reinstalled in a reverse orientation. Groove 104 may be located opposite the hook and may be used to guide the spring transversely and also may allow for pushing the spring back into position through the opening and into the slot of the magazine release button. Handle 105 may be on the opposite end of the tool from the blade end and may be used to aid in axial rotation of the tool as the hook is initially inserted under the spring in an embodiment of the present disclosure.

A variation of tool 101 conducive to an alternate manufacturing method wherein the head of the tool may allow for transverse camming of the free end of the spring is presented as item 150 (FIG. 27). The body of the tool also may serve as handle 151, and the handle may be of a different cross-sectional shape than the body of the tool in some embodiments of the present disclosure. The tool may use elongated head 152 (FIG. 28) to act as a camming lever between the cavity sidewall and the free end of the spring in an embodiment of the present disclosure. Right-angle extension 153 in the elongated head of the tool may allow for engagement with the free end of the spring and may allow the spring to be lifted away from the magazine release button so that disengagement may occur between the spring and the magazine release button. With no less functionality but dependent on manufacturing method, the right angle extension feature may be replaced with a notch which may engage the spring and result in the same spring-lifting capability in an embodiment of the present disclosure. Spoon-shaped cavity 154 (FIG. 29) at the opposing end of the tool from the elongated head may be used to lift the spring away from the magazine release button, allowing for removal and re-installation of the replacement button. Chamfer 155 (FIG. 29) on the side of the body opposite the cavity may allow for easier lifting of the spring end away from the cavity. Notched blade 156 may allow for re-seating of the free end of the spring into the slot of the magazine release button and may allow for pressure to be applied to the spring to push the free end through the opening and into the slot of the magazine release button in an embodiment of the present disclosure.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. An arrowhead assembly comprising:

a connector element having a first radius adapted to connect to a forward end of a shaft;

an arrowhead body pivotally connected to the connector element;

the arrowhead body including a center portion and a plurality of blades each extending from the center portion;

the blades extending radially to a blade radius greater than the first radius of the connector element;

a ball and socket mechanism connecting the connector element and the arrowhead body;

wherein the arrowhead body and the connector element are adapted to pivot about a pivot point, and wherein the arrowhead body has a neutral point aft of the pivot point;

wherein each of the blades has a rear portion extending aft of the pivot point; and wherein the arrowhead body includes a plurality of blades.

2. The arrowhead assembly of claim 1 wherein the connector element has a threaded element adapted to be threadably received by the shaft.

3. The arrowhead assembly of claim 1 wherein the connector element defines a socket and the arrowhead body includes a ball.

4. The arrowhead assembly of claim 1 wherein the arrowhead body includes a central base connected to the connector element, and each of the blades has a forward portion connected to the base, and an aft portion spaced apart from the aft portions of the other blades to define an aft space aft of the base.

5. The arrowhead assembly of claim 4 wherein the connector element is received in the aft space.

6. The arrowhead assembly of claim 4 wherein the aft portions of the blades are laterally spaced apart from the connector element.

7. The arrowhead assembly of claim 1 further comprising an immobilizer defining a first surface adapted to contact the shaft, and having a second surface contacting a portion of the arrowhead body.

8. The arrowhead assembly of claim 7 wherein the immobilizer is removably attached to the arrowhead body.

9. The arrowhead assembly of claim 7 wherein the immobilizer defines a central aperture closely receiving the shaft.

10. The arrowhead assembly of claim 7 wherein the immobilizer has a planar form oriented perpendicularly to an axis defined by the shaft.

11. The arrowhead assembly of claim 7 wherein the immobilizer is adapted to fall away from the arrowhead body when an arrow including the arrowhead body is launched.

12. The arrowhead assembly of claim 7 wherein the immobilizer is a tube.

13. The arrowhead assembly of claim 1 wherein the arrowhead body is further adapted to roll about a pivot point.

14. The arrowhead assembly of claim 13 wherein the arrowhead body has a plurality of blades, and each of the blades incorporates designed asymmetry to induce rolling of the arrowhead body with respect to the shaft.

* * * * *